United States Patent [19]

Okuyama et al.

[11] Patent Number: 4,697,931

[45] Date of Patent: Oct. 6, 1987

[54] ELECTRONIC TIMEPIECE INCLUDING SLIDABLE DIGITAL DISPLAY SECTIONS

[75] Inventors: Masayoshi Okuyama; Yukio Kido; Isao Mimura; Etsuro Nakajima, all of Tokyo, Japan

[73] Assignee: Casio Computer Co., Ltd., Tokyo, Japan

[21] Appl. No.: 923,394

[22] Filed: Oct. 23, 1986

[30] Foreign Application Priority Data

Oct. 28, 1985 [JP] Japan ..... 60-239462
Dec. 2, 1985 [JP] Japan ..... 60-269321

[51] Int. Cl.[4] ..... G04B 19/00; G04B 37/00
[52] U.S. Cl. ..... 368/223; 368/276
[58] Field of Search ..... 368/76, 82, 88, 223, 368/228, 276, 278, 309

[56] References Cited

U.S. PATENT DOCUMENTS 4,168,607 9/1979 Friedman ..... 368/283
4,236,239 11/1980 Imgbuth et al. ..... 368/72
4,444,513 4/1984 Proellochs ..... 368/223
4,470,708 9/1984 Mee ..... 368/276

*Primary Examiner*—Vit W. Miska
*Attorney, Agent, or Firm*—Frishauf, Holtz, Goodman & Woodward

[57] ABSTRACT

A slidable member having an optical display unit is provided in an electronic timepiece case to be slidable to first and second stop positions respectively. The optical display unit is exposed to the outside of the timepiece case with a larger display area thereof when the slidable member has been slid to the second stop position than to the first stop position. Different data items are displayed on the optical display unit by first and second data supply means when the slidable member has been slid to the first and second stop positions respectively.

25 Claims, 33 Drawing Figures

ELECTRONIC TIMEPIECE INCLUDING SLIDABLE DIGITAL DISPLAY SECTIONS

BACKGROUND OF THE INVENTION

1. Field of the Invention

The present invention relates to an electronic timepiece wherein a plurality of information items are selectively displayed on a single optical display unit.

2. Description of Related Art

Recent digital display type electronic timepieces available on the market display time on an optical digital display unit such as a liquid crystal display unit. In a conventional digital display electronic timepiece of this type, a digital display unit is fixed on the surface of the timepiece and is constantly exposed. Therefore, even when data need not be displayed, i.e., even when no data is displayed, the digital display unit is seen from outside, resulting in an aesthetically poor appearance. Furthermore, the digital display unit may be damaged.

To solve such drawbacks, in an electronic timepiece proposed in U.S. Pat. No. 4,168,607 to Friedman, the digital display unit is housed in the watch case while time display is not needed, and the digital display unit is popped up by a switch operation and simultaneously the time is displayed.

Along with the recent trend toward a multifunctional timepiece, however, a plurality of function data such as date, day, alarm, and stopwatch data, are selectively displayed on the digital display unit in addition to the time data. When the plurality of functions are selectively displayed, the number of digits required for display differs depending on the respective functions. When time is displayed, four digits are required. For the stopwatch function, six digits are required. However, if the entire display unit is popped up and only a small number of display digits are required, some digits remain unused, resulting in an aesthetically poor appearance.

In a multifunctional timepiece of this type, the functions are switched by a push button. Therefore, a push button must be provided on the timepiece case, again resulting in an aesthetically poor appearance and poor operability.

In combination timepieces also available on the market, liquid crystal display units are provided in analog display electronic timepieces in order to provide multifunctions, such as date, day, alarm, and stopwatch data.

In a combination timepiece of this type, however, two display means are provided on a single surface. More particularly, a window exposing a digital display unit is formed within an analog display face. When such a combination timepiece is of a digital type, a digital display unit is constantly seen from outside, thus degrading the overall appearance.

In order to prevent such difficulties, as described in U.S. Pat. No. 4,444,513 to Proellochs, a digital display unit is movably provided on the analog timepiece main body. When the digital display unit is pulled out, time is displayed thereon.

When another function is to be displayed, however, the number of digits required for the display differs depending on the functions. For example, four digits are required to display time, and six digits are required to provide a stopwatch function. When the display unit is pulled out by one step for display, if the data to be displayed requires only a small number of digits, some digits remain unused, thus degrading the outer appearance.

SUMMARY OF THE INVENTION

It is an object of the present invention to provide an electronic timepiece having a good design appearance wherein a display section having only a size corresponding to the number of digits required for displaying desired data is exposed while a plurality of data pieces are selectively displayed on an optical display section.

It is another object of the present invention to provide an electronic timepiece which can reliably, selectively display a plurality of data pieces with a simple operation.

To achieve the above objects and other features of the invention, an electronic timepiece according to the present invention comprises:

a timepiece case;

an electronic circuit, provided inside the timepiece case, for outputting a plurality of data items containing time data;

a movable member arranged inside the timepiece case, including an optical display unit, and movable to at least first and second stop positions, the optical display unit being exposed the outside of the timepiece case, with having a larger display region when it is moved to the second stop position rather than when it is moved to the first stop position;

detecting means for detecting that the movable member has been moved to the first and second stop positions, respectively;

first data supply means for supplying one data item of said plurality of data items output from said electronic circuit to the optical exposed display unit when the detecting means detects that the movable member has been moved to the first stop position; and second data supply means for supplying another data item of the plurality of data items output from the electronic circuit to the exposed optical display unit when the detecting means detects that the movable member has been moved to the first stop position.

With the above arrangement, the size of the display section changes in accordance with the number of digits of the data to be displayed, thus achieving a good outer appearance.

Data is selectively displayed by pulling out and pushing in of a movable member. Therefore, data can be switched easily and reliably.

BRIEF DESCRIPTION OF THE DRAWINGS

FIG. 2 shows used states of the first embodiment, in which

FIG. 3 shows mode selection switches of the first embodiment, in which

FIG. 6 shows used states of an electronic timepiece according to a second embodiment of the present invention, in which

FIG. 21 shows used states of an electronic timepiece according to a fifth embodiment of the present invention, in which

DETAILED DESCRIPTION OF THE PREFERRED EMBODIMENT

ARRANGEMENT OF FIRST TIMEPIECE

Figure 1A:
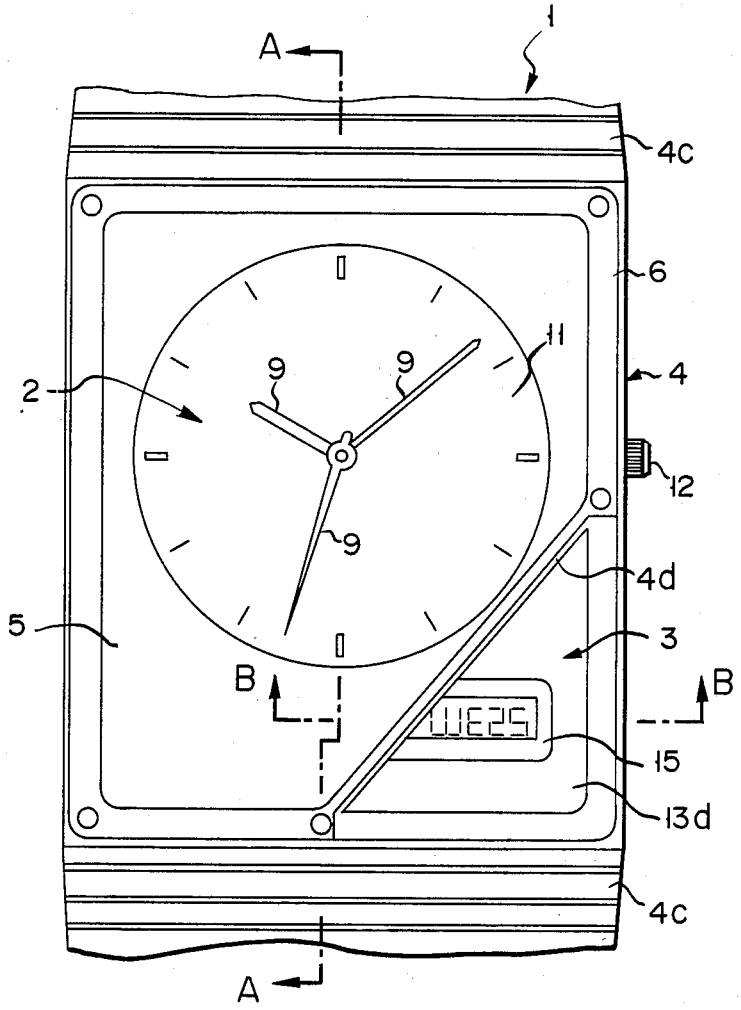
FIG. 1(A) is a plan view of an outer appearance of an electronic timepiece according to an embodiment of the present invention.
Figure 1B:
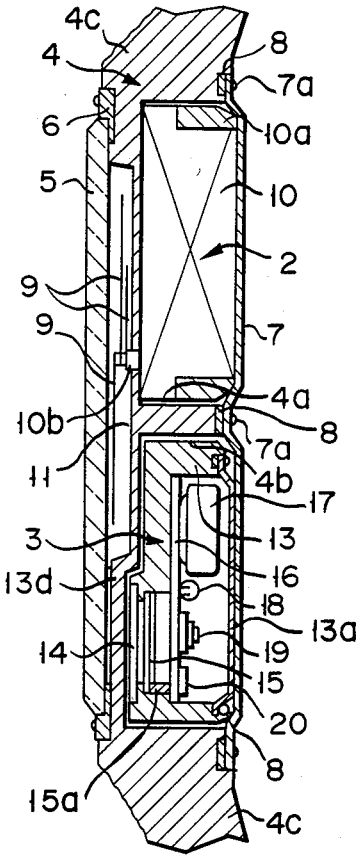
FIG. 1(B) is a sectional view taken along the line A—A of FIG. 1(A)
Figure 1C:
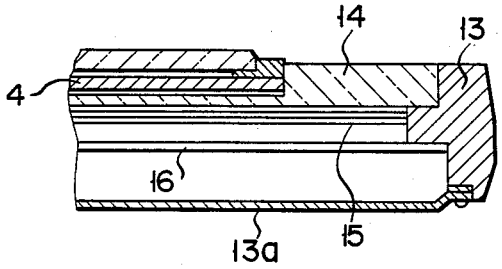
FIG. 1(C) is a sectional view taken along the line B—B of FIG. 1(A)

FIGS. 1 to 5 show a first embodiment of the present invention, in which FIGS. 1(A) to 1(C) show electronic wristwatch 1. Wristwatch 1 has analog and digital timepiece sections 2 and 3. Timepieces sections 2 and 3 are housed in analog and digital housings 4*a* and 4*b* of timepiece case 4, respectively.

Case 4 is made of a synthetic resin and integrally formed with timepiece straps 4*c* at its ends. Timepiece glass 5 is fitted on case 4 by bezel 6. Analog and digital housings 4*a* and 4*b* are formed at front and rear portions inside case 4 (vertically in FIG. 1(B)). Case back cover 7 is provided at the rear surface (the righthand side in FIG. 1(B)) of case 4 by screws 7*a* through waterproof packing 8. In this case, analog and digital timepiece sections 2 and 3 partially overlap each other. The lower right corner of glass 5 is cut out in a substantially triangular shape. Part of timepiece section 3 is exposed from opening 4*d* of the cutout lower right corner of glass 5. Housings 4*a* and 4*b* for housing timepiece sections 2 and 3, respectively, are open to the rear side of case 4 and are covered with cover 7. In this case, particularly concerning housing 4*b*, its lower right opening 4*d* and side portions are open, and part of digital timepiece 3 can be pulled out and pushed in with respect to case 4 from the open side portions.

Analog timepiece section 2 moves hands 9 to indicate time. As shown in FIG. 1(B), analog block 10 is fixed within housing 4*a* by press ring 10*a*. Face 11 is arranged on block 10 (the left-hand side of block 10 in FIG. 1(B)). Hand shaft 10*b* of block 10 extends through dial 11. Hands 9 are movably mounted on extending shaft 10*b*. In this case, dial 11 is larger than housing 4*a* and partially overlaps housing 4*b*, as shown in FIGS. 1(A) and 1(B). Crown 12 projects from the side surface of housing 4*a* to outside case 4. Crown 12 is used for correcting time indicated on analog timepiece section 2.

Digital timepiece section 3 electro-optically displays time. As shown in FIGS. 1(A) to 1(C), case 13 is arranged in digital housing 4*b*. Case 13 slides along the front and rear walls of housing 4*b*. The right side portion of case 13 can project from and be retracted into case 4. The upper portion of case 13 is formed such that its triangular portion 13*d* corresponding to opening 4*d* on the lower right portion of analog timepiece section 2 is high, i.e., substantially flush with glass 5. The remaining portion of the upper portion of case 13 is lower than portion 13*d*. Protection glass 14 provided on the upper portion of case 13 is elongated along the travel direction thereof. Glass 14 protects liquid crystal display unit 15, to be described later. A portion of glass 14 corresponding to lower right opening 4*d* (the right side portion in FIG. 1(C)) is thick, and the remaining portion (the left side portion) is thin. Unit 15, circuit board 16, cell 17, and so on are arranged inside glass 14. Unit 15 displays time and the like, is arranged to oppose the inner surface of glass 14, and is electrically connected to board 16 through inner connector 15*a*. Board 16 supplies drive signals to unit 15 and analog block 10 of analog timepiece section 2. Electronic components, such as quartz oscillator 18, trimmer capacitor 19 and LSI 20, are provided under board 16, and board 16 is electrically connected to block 10. Cell 17 supplies power to board 16. The two electrodes of cell 17 are connected to board 16.

Figures 2A, 2B, 2C:
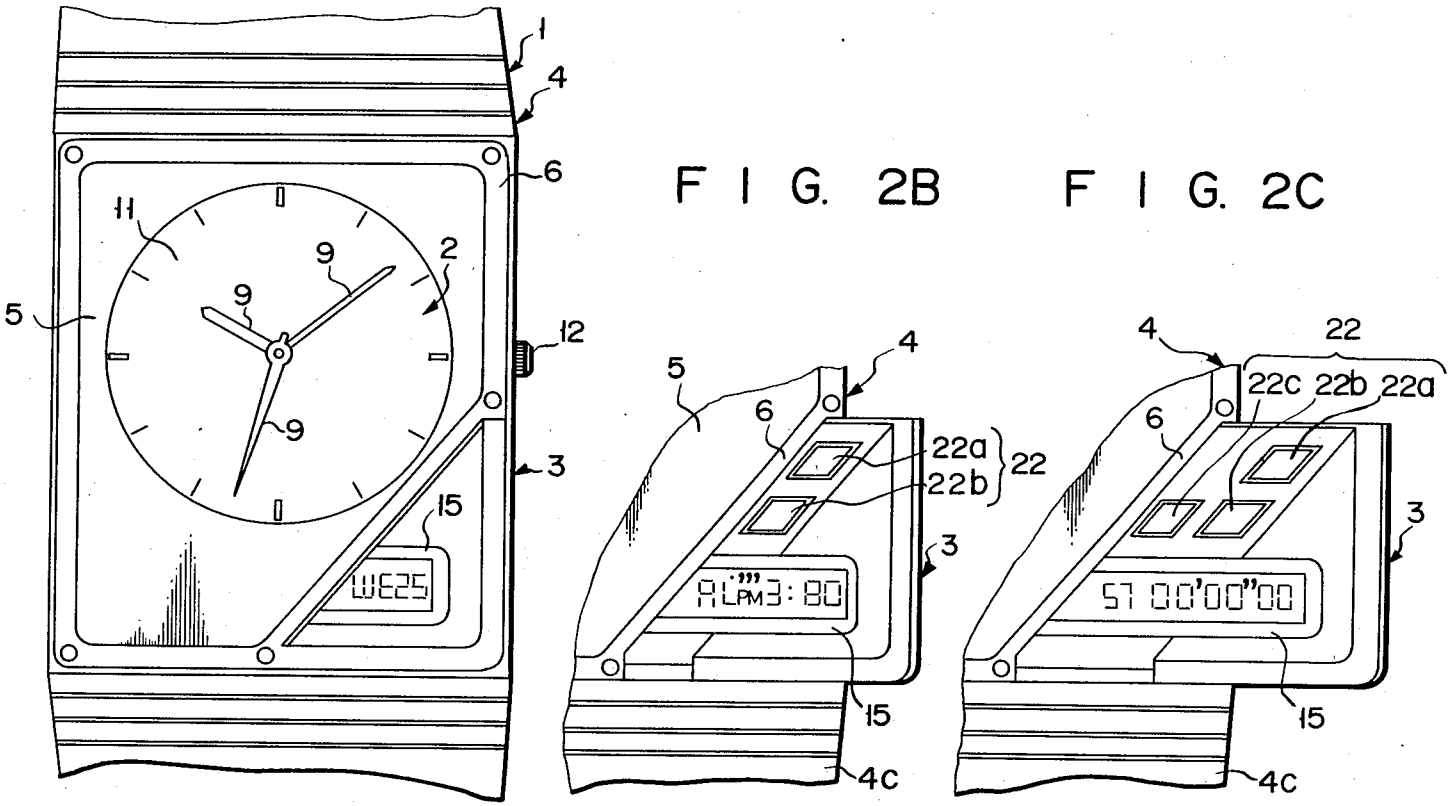
FIG. 2(A) is a plan view of an outer appearance in a state wherein a digital timepiece section is housed.
FIG. 2(B) is a plan view of a main part in a state wherein the digital timepiece section is pulled out in one step.
FIG. 2(C) is a plan view of a main part in a state wherein the digital timepiece section is pulled out in two steps.
Figure 3B:
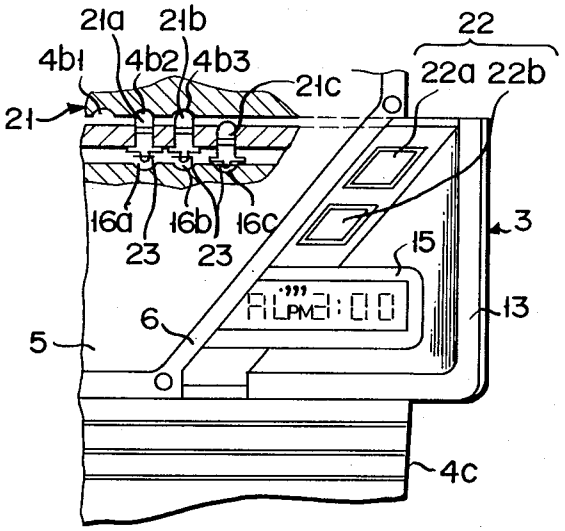
FIG. 3(B) is a sectional view of a state wherein an alarm mode is set.
Figure 3A:
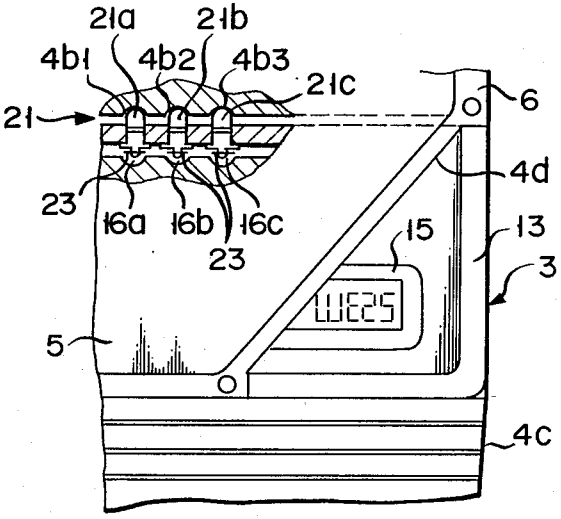
FIG. 3(A) is a sectional view of a state wherein a date-day mode is set.
Figure 3C:
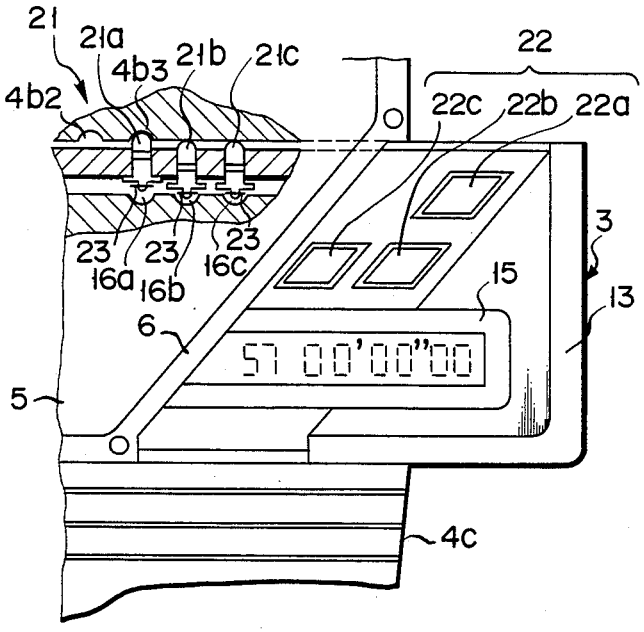
FIG. 3(C) is a sectional view of a state wherein a stopwatch mode is set.

Digital timepiece section 3 has mode selection switch 21 and key switch section 22, as shown in FIGS. 2 and 3. Switch 21 switches the mode of digital timepiece section 3 in accordance with the pullout operation of case 13. Switch 21 has three operation elements 21*a*, 21*b*, and 21*c*, as shown in FIG. 3, and is provided on the side surface of case 13. More specifically, elements 21*a*, 21*b*, and 21*c* are elastically biased at inner end portions thereof by leaf springs 23 so that they project from or are contracted in the side wall of case 13 in response to pullout operation of case 13. As shown in FIG. 2(A), when timepiece section 3 is housed in housing 4*b*, as shown in FIG. 3(A), the distal ends of elements 21*a*, 21*b*, and 21*c* project from the side wall of case 13. The projecting distal ends are inserted in recesses $4b_1$, $4b_2$, and $4b_3$ formed in the wall of housing 4*b* of case 4. The opposite inner ends of elements 21*a*, 21*b*, and 21*c* are then separated from contact electrodes 16*a*, 16*b*, and 16*c* provided on board 16 inside case 13. Three elements 21*a*, 21*b*, and 21*c* are thus turned off. In this state, switch 21 is switched to the date-day mode, and date and day are displayed by display unit 15, as shown in FIG. 2(A). When timepiece section 3 is pulled out from housing 4*b* in one step, as shown in FIG. 2(B), elements 21*a*, 21*b*, and 21*c* are moved in the same direction by the movement of case 13. As shown in FIG. 3(B), the distal end of rightmost element 21*c* is abutted against the wall of housing 4*b*, and the opposite inner end thereof contacts electrode 16*c* on the right side portion of board 16, so that element 21*c* is turned on. The distal ends of remaining elements 21*a* and 21*b* are inserted in adjacent recesses $4b_2$ and $4b_3$, respectively, and opposite inner ends thereof are separated from electrodes 16*a* and 16*b*, respectively, of board 16, so that elements 21*a* and 21*b* are turned off. In this state, switch 21 is set in the alarm mode, and alarm sign and alarm time are displayed on display unit 15, as shown in FIG. 2(B). Subsequently, assume that timepiece section 3 is pulled out from housing 4*b* in two steps, as shown in FIG. 2(C). Then, elements 21*a*, 21*b*, and 21*c* are further moved by the movement of case 13 in a similar manner. As shown in FIG. 3(C), the distal ends of right elements 21*b* and 21*c* are abutted against the wall of housing 4*b*, and the opposite inner distal ends thereof contact electrodes 16*b* and 16*c* on the right-side portion of board 16, so that elements 21*b* and 21*c* are turned on. The distal end of remaining element 21*a* is inserted in adjacent recess $4b_3$, and the opposite inner thereof is separated from electrode 16*a* of board 16, so that element 21*a* is turned off. In this state, mode selection switch 21 is set in the stopwatch mode, and the start state of a stopwatch time is displayed on display unit 15, as shown in FIG. 2(C).

Figure 4:
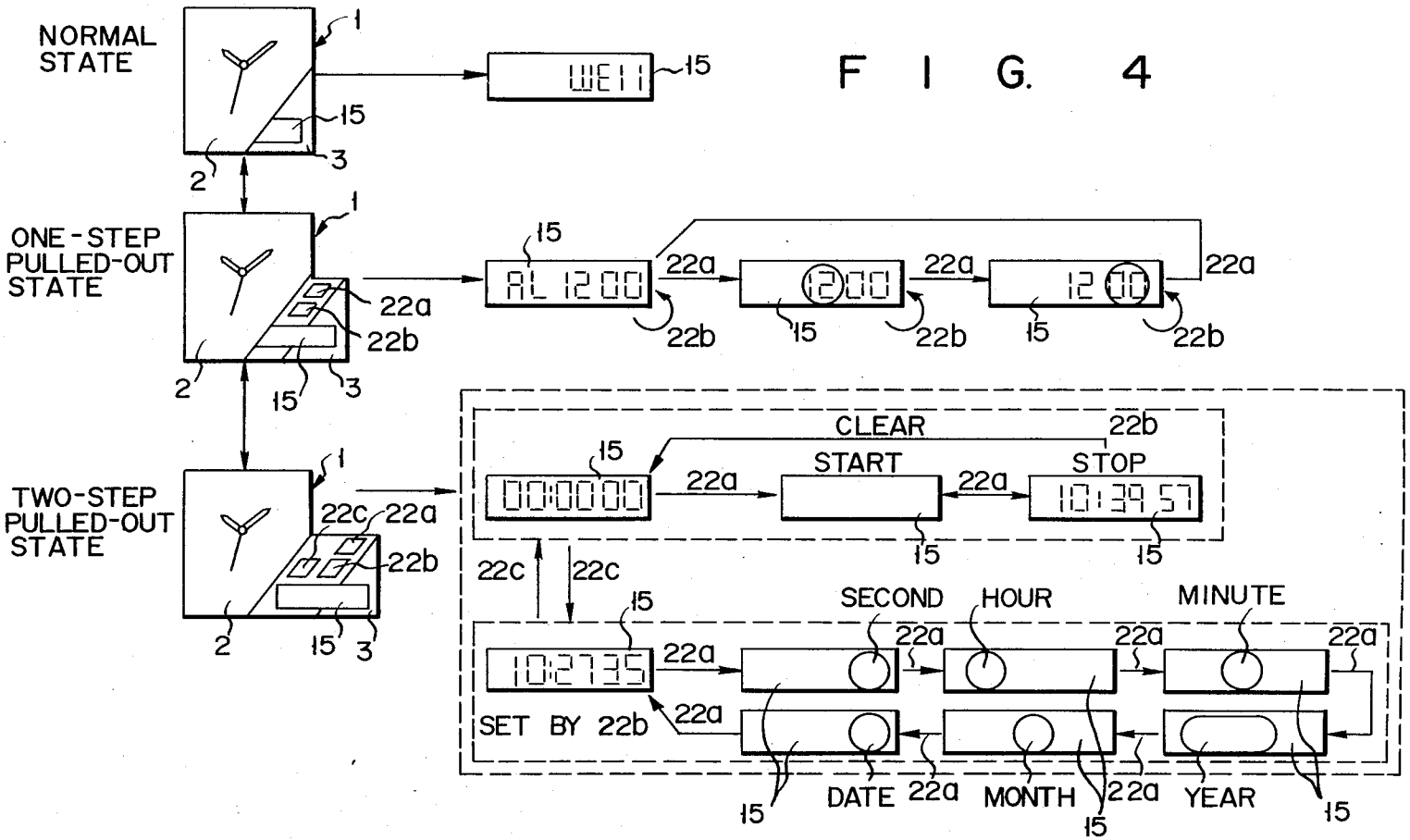
FIG. 4 shows the operation specification of the digital timepiece section of the first embodiment.

Key switch section 22 consists of three types of switches, i.e., select switch 22*a*, set switch 22*b*, and correction switch 22*c*, and is provided on case 13 of timepiece section 3. As shown in FIG. 2(A), when timepiece section 3 is housed in housing 4*b*, switches 22*a* to 22*c* are concealed. As shown in FIG. 2(B), when timepiece section 3 is pulled out from housing 4*b* in one step, switches 22*a* and 22*b* are exposed. As shown in FIG. 2(C), when timepiece section 2 is pulled out from housing 4*b* in two steps, switches 22*a* to 22*c* are exposed. Switches 22*a* and 22*b* serve to correct time data displayed on display unit 15, and are used to set an alarm time in the state of FIG. 2(B). Switch 22*a* selectively designates a digit and indicates the designated digit by flashing it. Switch 22*b* increments the indicated digit by 1. More particularly, in the alarm mode (the state of FIG. 2(B)) wherein digital timepiece section 3 is pulled out in one step, every time select switch 22*a* is depressed, it carries up the digits of the alarm time and indicates the hour and minute digit by flashing, as shown in FIG. 4. Every time switch 22*b* is depressed, the indicated digits are sequentially incremented one by one to correct the alarm time. In the stopwatch mode (the state of FIG. 2(C)) wherein timepiece section 3 is pulled out in two steps, switch 22*a* starts/stops the stopwatch, and switch 22*b* clears the measured value. If switch 22*c* is depressed in the state of FIG. 2(C) wherein timepiece section 3 is pulled out in two steps, the current time (time, date, day, and so on) is corrected in the same manner as in the alarm mode. Switch 22*c* switches between the stopwatch mode and a time display mode for displaying the current time and is exposed only in the stopwatch mode (FIG. 2(C)) wherein timepiece section 3 is pulled out in two steps. In this state, when switch 22*c* is depressed once, timepiece section 3 is switched to the time display mode to display the current time. When switch 22*c* is depressed again, timepiece section 3 is switched to the stopwatch mode.

Figure 5:
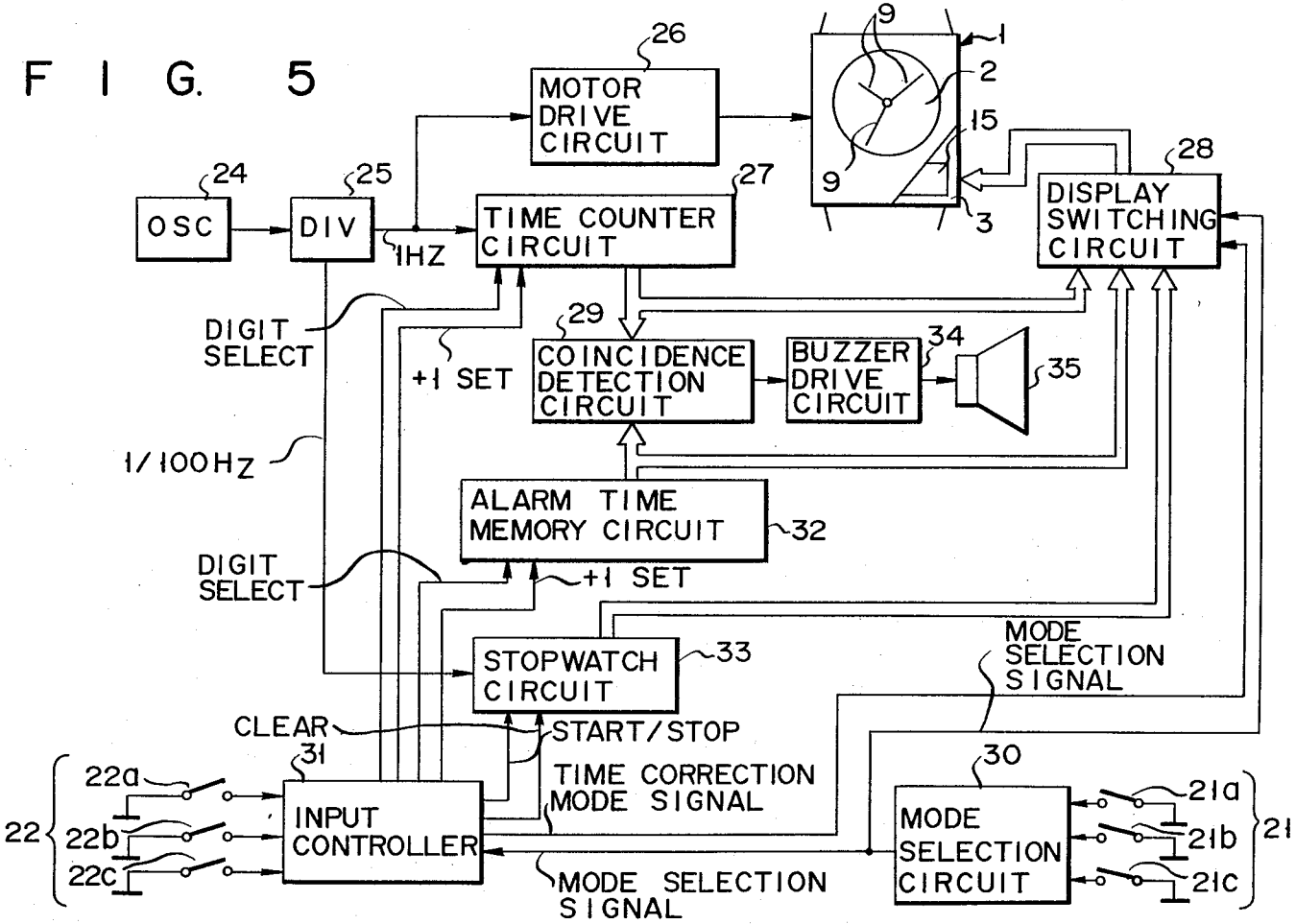
FIG. 5 is a circuit block diagram of the first embodiment.

The circuit configuration of electronic timepiece 1 will now be described with reference to FIG. 5.

Oscillating circuit (OSC) 24 supplies an oscillation signal to frequency dividing circuit (DIV) 25. The oscillation signal is frequency-divided by frequency dividing circuit 25. Among the frequency-divided signals output from frequency dividing circuit 25, a 1-Hz signal is supplied to motor drive circuit 26 of analog time section 2 and drives analog block 10, thereby moving hands 9 forward. At the same time, the 1-Hz signal is also supplied to time counter circuit 27 of digital timepiece section 3. Counter circuit 27 counts the 1-Hz signals from frequency dividing circuit 25 and supplies time data to display switching circuit 28 and coincidence detection circuit 29. Display switching circuit 28 switches display of display unit 15 among three types of display, i.e., day/date, alarm, and stopwatch in accordance with a mode selection signal from mode selection circuit 30, and switches the same to time display by the time correction mode signal from input controller 31 to be described later. Mode selection circuit 30 receives three types of signals from mode selection switch 21 in accordance with the pulled-out state of digital timepiece section 3 from housing 4*b*. In accordance with the received signal, mode selection circuit 30 supplies mode selection signals to display switching circuit 28 and to input controller 31. Controller 31 receives the selection signal from mode selection circuit 30 and three types of switch signals supplied from key switch section 22 provided on case 13 of timepiece section 3. In accordance with these signals, controller 31 outputs digit select and +1 set signals to counter circuit 27 and alarm time memory circuit 32, respectively, start/stop or clear signal to stopwatch circuit 33, and a time correction mode signal to display switching circuit 28.

Counter circuit 27 supplies time data to switching circuit 28 and coincidence detection circuit 29 based on the 1-Hz signal from frequency dividing circuit 25. As shown in FIG. 2(A), day and date are displayed on display unit 15 in a state wherein timepiece section 3 is housed in housing 4*b*. More particularly, when timepiece section 3 is housed in housing 4*b*, elements 21*a*, 21*b*, and 21*c* of mode selection switch 21 are turned off. These switching signals are supplied to mode selection circuit 30, a date-day mode signal is output from mode selection circuit 30 to display switching circuit 28, and day and date are displayed on display unit 15 among the time data supplied to display circuit 28.

Alarm time memory circuit 32 supplies stored alarm time data to detection and display switching circuits 29 and 28. When the alarm time data supplied to detection circuit 29 coincides with the time data supplied from counter circuit 27, a coincidence signal is output from detection circuit 29 to buzzer drive circuit 34, and an alarm sound is produced from speaker 35. When timepiece section 3 is pulled out in one step from housing **4*b*, as shown in FIG. 2(B), and display switching circuit 28 is switched to the alarm display mode by the mode selection signal from mode selection circuit 30, the alarm time data supplied to switching circuit 28 is displayed on display unit 15. In this state, when switches 22*a* and 22*b* of key switch section 22 are operated, a digit select signal and a +1 set signal are output from input controller 31 to memory circuit 32. In accordance with these signals, the alarm time stored in memory circuit 32 is corrected, and the corrected alarm time data is displayed on display unit 15 through switching circuit 28**.

Stopwatch circuit 33 receives a 1/100-Hz signal from frequency dividing circuit 25 and supplies time count data of the stopwatch to switching circuit 28. Normally, the time count data is not displayed on display unit 15. When timepiece section 3 is pulled out from housing **4*b* in two steps and switching circuit 28 is switched to the stopwatch display mode by the mode selection signal from selection circuit 30, "00;00;00" is displayed on display unit 15. When timepiece section 3 is pulled out from housing 4*b* in two steps, in this manner, mode selection circuit 30 supplies a mode selection signal to controller 31 switches the functions of select switches 22*a* and 22*b* of switch section 22, and outputs a start/-stop signal upon operation of switch 22*a*. At the same time, a clear signal is output based on the operation of switch 22*b*. In this state, when switch 22*a* of switch section 22 is depressed once and turned on, a start signal is supplied from input controller 31 to stopwatch circuit 33. In response to the start signal, stopwatch circuit 33 starts counting and displays the counted data to display unit 15 through switchinq circuit 28. When switch 22*a* is depressed aqain and turned on, a stop siqnal is supplied from controller 31 to stopwatch circuit 33, stopwatch circuit 33 stops counting. and the count result (measured value) is displayed on display unit 15. When switch 22*b* of switch section 22 is depressed, a clear signal is supplied from controller 31 to stopwatch circuit 33, the count thereof is cleared, and an initial state of the stopwatch "00;00;00" is displayed on display unit 15. When switch 22*c* of switch section 22 is depressed, switching circuit 28 is set to the time correction mode by a time correction signal from controller 31, and time data such as the current time, date, day and the like is displayed on display unit 15. When switches 22*a* and 22*b* of switch section 22 are operated, a digit select signal and a +1 set signal are supplied from controller 31 to counter circuit 27, and time correction is enabled. More particularly, in this state, when switches 22*a* and 22*b* are operated, time data of counter circuit 27, such as the current time, date, day and the like, is corrected in accordance with the diqit select signal and +1 set signals from controller 31. The corrected time data is displayed on display unit 15 through display switching circuit 28. Note that when switch 22*c* is depressed again after time correction, timepiece section 3 is switched to the stopwatch mode. In this state, when timepiece section 3 is housed in housinq 4*b*, switching circuit 28 is switched to the date-day mode, and date and day are displayed on display unit 15**.

ADVANTAGES OF FIRST TIMEPIECE

With the electronic timeoiece having the above arrangement, timepiece section 3 is housed in housing **4*b* to be capable of being pulled out and pushed in. Therefore, the display state (face of the timepiece) of the entire timepiece, the shape, the outer appearance and so on are varied, so that an electronic timepiece of a new image different from that of the conventional timepiece can be provided. Particularly, when timepiece section 3 is housed in housing 4*b* of timepiece case 4, only part thereof is exposed from opening 4*d* on the lower right portion of case 4. Therefore, the exposed portion of timepiece section 3 during use can be reduced, and a hiqh-quality watch as a combination watch can be provided. In addition, since analog and digital timepiece sections 2 and 3 partially overlap each other, the entire timepiece can be made compact, and the area of either one (analog timepiece section 2 in this embodiment) of the display sections can be increased. Also, a plurality of switches, such as mode selection switch 21, key switch section 22, and the like, can be provided on timepiece section 22, thus providing a plurality of functions. Even with the multifunctional watch, when timepiece section 3 is housed in housing 4*b*, the various types of switches provided on timepiece section 3 are not exposed to the outside but are completely concealed. Therefore, the number of externally exposed switches can be decreased to provide a high-quality timepiece having a simple outer appearance. The number of displayed digits on quartz display unit 15 of digital timepiece section 3 varies in accordance with the pulling operation of timepiece section 3**. Thus, data in a mode corresponding to the pulled-out state can be readily and quickly read out.

The various types of switches, such as mode selection switch 21 and key switch 22, are concealed when retracted, yet capable of projecting from housing **4*b* of case 4, as mentioned above. Therefore, the switches will not be erroneously operated during use, thus reliably preventing the switches from being erroneously operated. Particularly, mode selection switch 21 is automatically switched in accordance with the pulling operation of timepiece section 3. Therefore, switch 21 can be easily operated and the mode thereof can be reliably switched. Only a required switch on key switch section 22 is exposed in accordance with the pulled-out state (mode) of timepiece section 3. Therefore, timepiece section 3** has a good operability and can be prevented from being erroneously operated, thus preventing erroneous input.

In the above embodiment, digital timepiece section 3 can be moved along the lateral direction of the timepiece main body. However, it can also be moved in the longitudinal or vertical direction.

In the above embodiment, "day-date" is displayed on quartz display unit 15 of digital timepiece section 3 since analog timepiece section 2 has three hands. When analog timepiece section 2 has two hands, however, "second" can be displayed by digital timepiece section 3.

ARRANGEMENT OF SECOND TIMEPIECE

FIGS. 6 to 9 show a second embodiment of the present invention. In the first embodiment, three modes are switched in accordance with the positions of the three steps of digital timepiece section 3. In the second embodiment, however, two different modes are displayed when digital timepiece section 3 is pulled out by two steps in different directions, so that a total of four different modes can be switched in accordance with the positions of the three steps of timepiece section 3.

The second embodiment will be described with reference to the accompanying drawings. Note that the same reference numerals as in the first embodiment denote the same parts, and a detailed description thereof is omitted.

In the second embodiment, mode selection switch 41 has two operation elements 41*a* and 41*b*, and three recesses 42*b*$_1$, 42*b*$_2$, and 42*b*$_3$ are formed at different intervals on the wall of digital housing 4*b* of timepiece case 4.

Figure 6B:
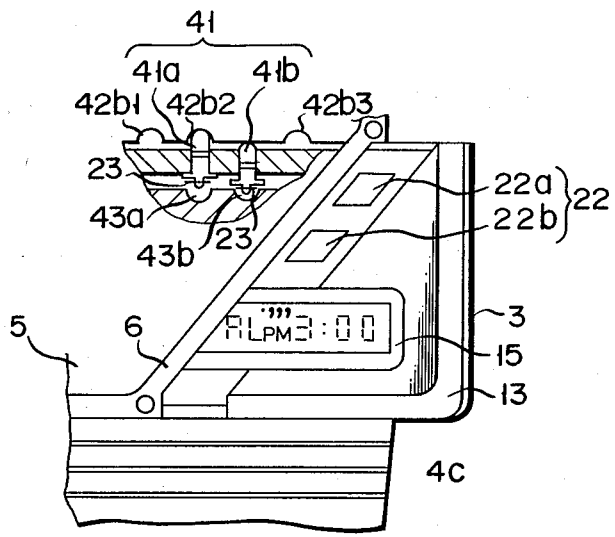
FIG. 6(B) is a plan view of a main part in a state wherein the digital timepiece section is pulled out in one step.
Figure 6A:
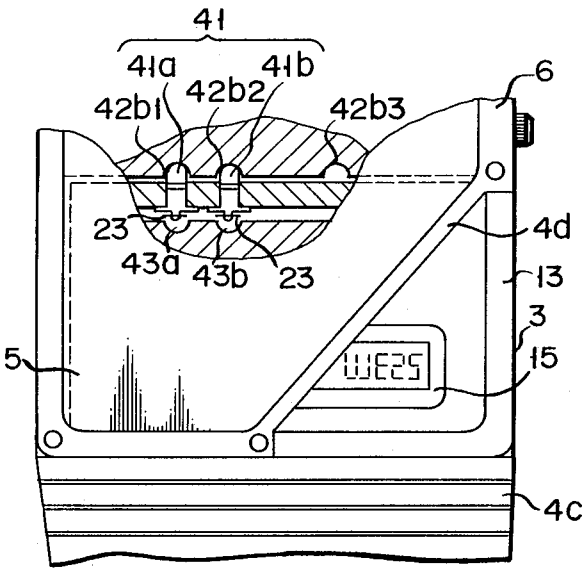
FIG. 6(A) is a plan view of an outer appearance in a state wherein a digital timepiece section is housed.
Figure 6D:
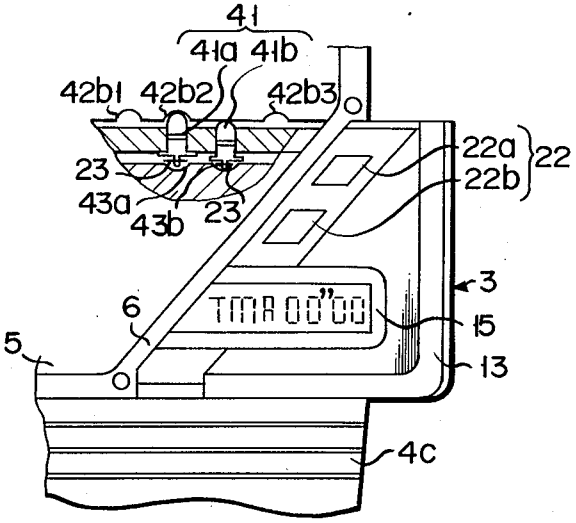
FIG. 6(D) is a plan view of a main part in a state wherein the digital timepiece section is pushed in in one step from the two-step pulled out state.
Figure 6C:
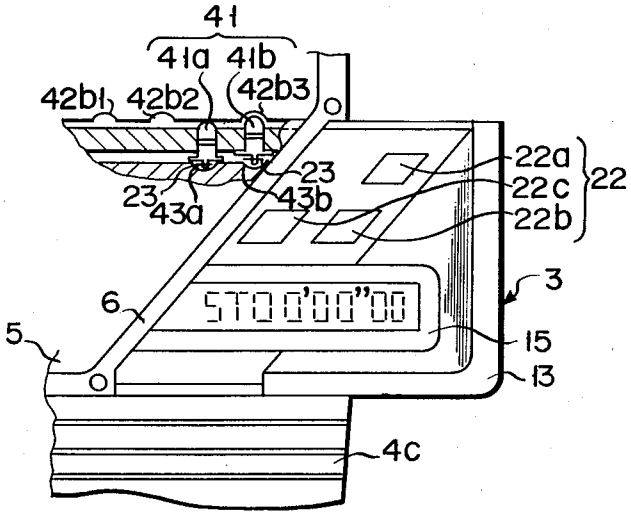
FIG. 6(C) is a plan view of a main part in a state wherein the digital timepiece section is pulled out in two steps.
Figure 7B:
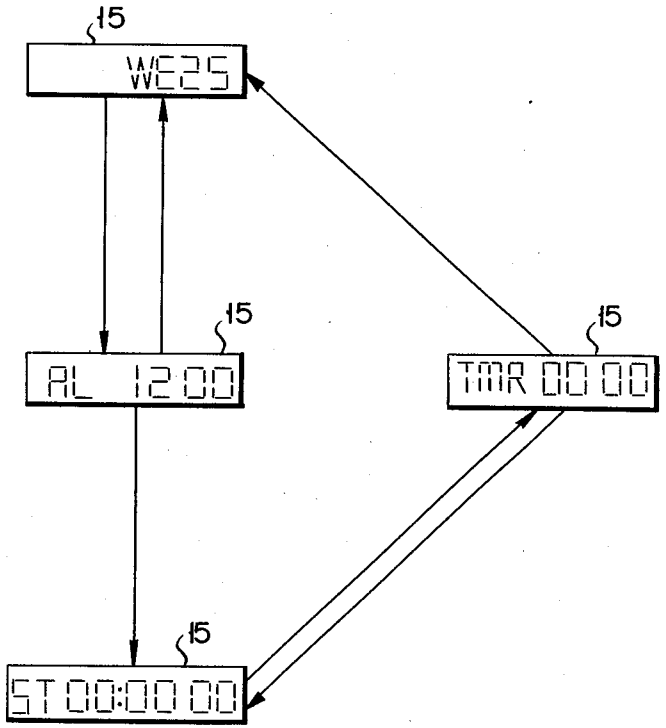
FIGS. 7(A) and 7(B) show operation specifications of the digital timepiece section of the second embodiment.
Figure 7A:
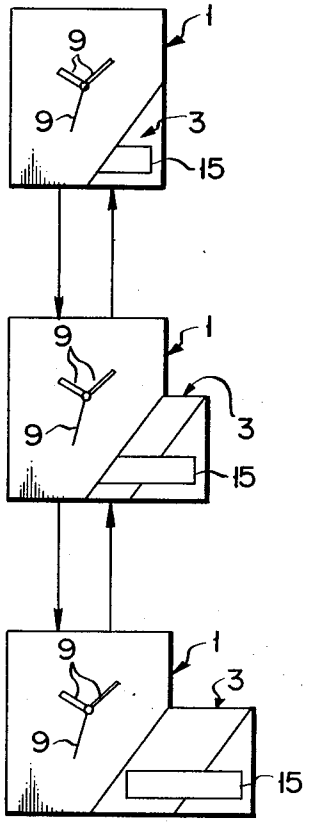

When digital timepiece section 3 is housed in digital housing 4*b*, as shown in FIG. 6(A), the distal ends of elements 41*a* and 41*b* project outward from the side wall of case 13. The projecting distal ends of elements 41*a* and 41*b* are inserted in recesses 42*b*$_1$ and 42*b*$_2$ formed in the wall of housing 4*b* of timepiece case 4, and the opposing inner ends thereof are separated from contact electrodes 43*a* and 43*b* provided on circuit board 16 inside case 13, so that elements 41*a* and 41*b* are turned off. In this state, mode selection switch 41 sets the date-day mode and day and date are displayed on liquid crystal display unit 15, as shown in FIGS. 6(A) and 7(B). As shown in FIG. 6(B), when timepiece section 3 is pulled out in one step from housing 4*b*, elements 41*a* and 41*b* are moved in the movement of case 13. The distal end of right element 41*b* is abutted against the inner wall of housing 4*b*, and the opposing inner end thereof contacts contact electrode 43*b* of board 16, so that element 41*b* is turned on. Meanwhile, the distal end of remaining element 41*a* is inserted in adjacent recess 42*b*$_2$, and the ooposing inner end thereof is separated from contact electrode 43*a* of board 16, so that element 41*a* is turned off. In this state, mode selection switch 41 sets the alarm mode, and alarm mode and alarm time are displayed on display unit 15, as shown in FIGS. 6(B) and 7(B). In this state, when timepiece section 3 is pushed into housing 4*b*, as shown in FIG. 6(A), the date-day mode is set. When timepiece section 3 is further pulled out from housing 4*b* in two steps, as shown in FIG. 6(C), elements 41*a* and 41*b* are further moved by the movement of case 13, in the same manner as described above. Then, the distal end of right element 41*b* is inserted in recess 42*b*$_3$ formed in wall of housing 4*b*, and the opposing inner end thereof is separated from right contact electrode 43*b* of board 16, so that element 41*b* is turned off. The distal end of remaining element 41*a* is abutted against the inner wall of housinq 4*b*, and the opposing inner end thereof contacts right contact electrode 43*a* of board 16, so that element 41*a* *is turned on. In this state, mode selection switch 41 sets the stopwatch mode, and the start state of the stopwatch time is displayed on display unit 15, as shown in FIG. 6(C). When timepiece section 3 pulled out in two steps is pushed into housing 4b* by one step, as shown in FIG. 6(D), elements 41*a* and 41*b* are moved to the left by the movement of case 13, and the state as shown in FIG. 6(B) described above is obtained. In this case, however, the mode is not the alarm mode, but is the timer mode, as shown in FIG. 7(B). More particularly, when timepiece section 3 is pushed in by one step, the timer mode is set by mode selection circuit 30 to be described later, and timer mode and timer time are displayed on display unit 15, as shown in FIG. 6(D). When timepiece section 3 is then pulled out from this state, as shown in FIG. 7(B), the stopwatch mode described above is set; when timepiece section 3 is further pushed in by two steps, the date-day mode described above is set.

CIRCUIT ARRANGEMENT OF TIMEPIECE

Figure 8:
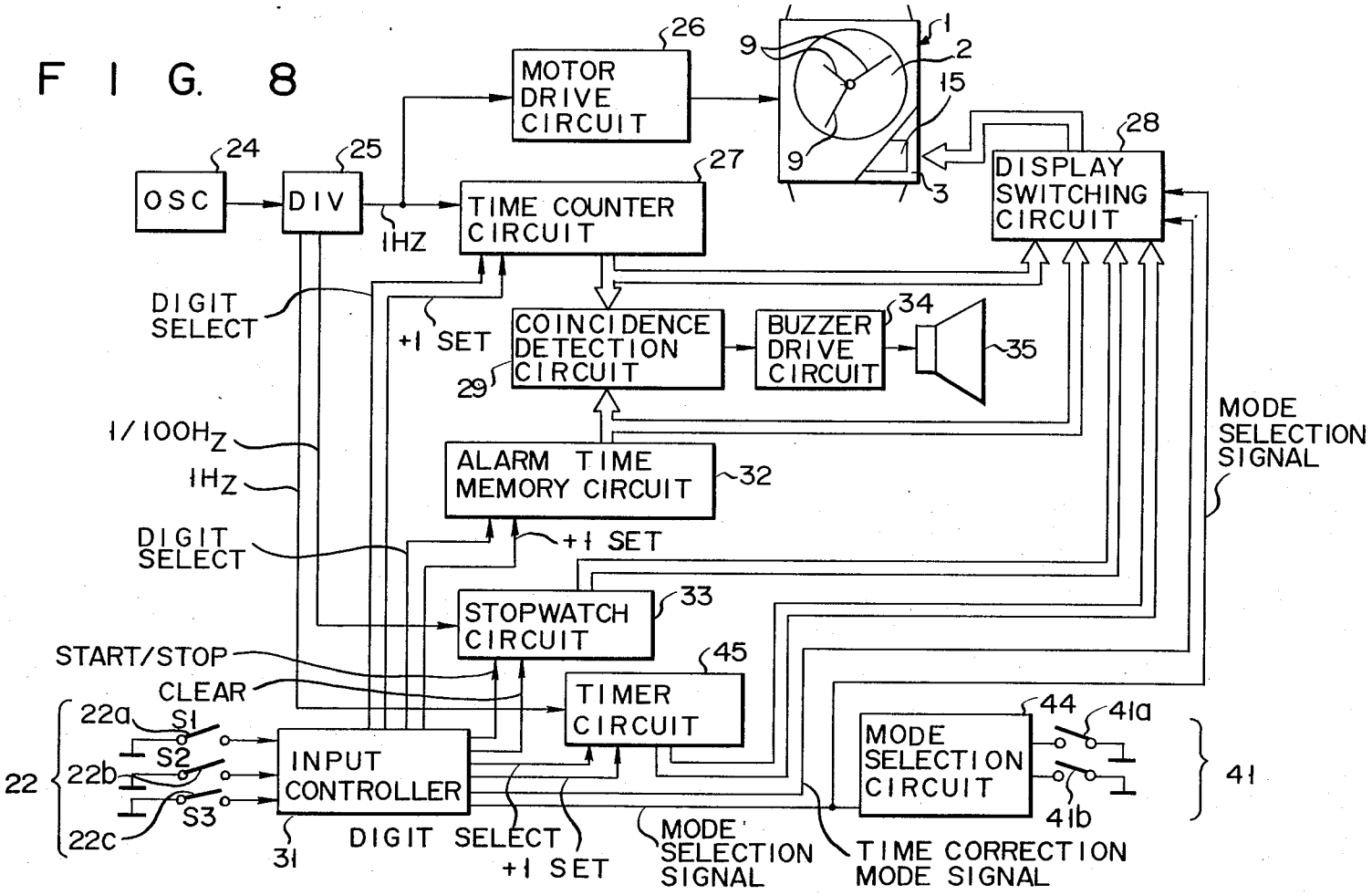
FIG. 8 is a circuit block diagram of the second embodiment.

The circuit configuration of electronic timepiece 1 described above will now be described with reference to FIG. 8.

Oscillating circuit (OSC) 24 supplies an oscillation signal to frequency dividing circuit (DIV) 25. The oscillation signal is frequency-divided by frequency dividing circuit 25. Among the frequency-divided signals output from frequency dividing circuit 25, a 1-Hz signal is supplied to motor drive circuit 26 of analog timepiece section 2 and drives analog block 10, thereby moving hands 9 forward (clockwise). At the same time, the 1-Hz signal is also supplied to time counter circuit 27 of digital timepiece section 3. Counter circuit 27 counts time in accordance with the 1-Hz signals from frequency dividing circuit 25 and supplies time data to display switching circuit 28 and coincidence detection circuit 29. Display switching circuit 28 switches display of display unit 15 among four types of display, i.e., day/date, alarm, stopwatch, and timer in accordance with a mode selection signal from mode selection circuit 44. Mode selection circuit 44 receives four types of signals in accordance with the pulling operation of digital timepiece section 3 from housing 4*b*. In accordance with the received signal, mode selection circuit 44 supplies four types of mode selection signals to display switching circuit 28 and to input controller 31.

Figure 9:
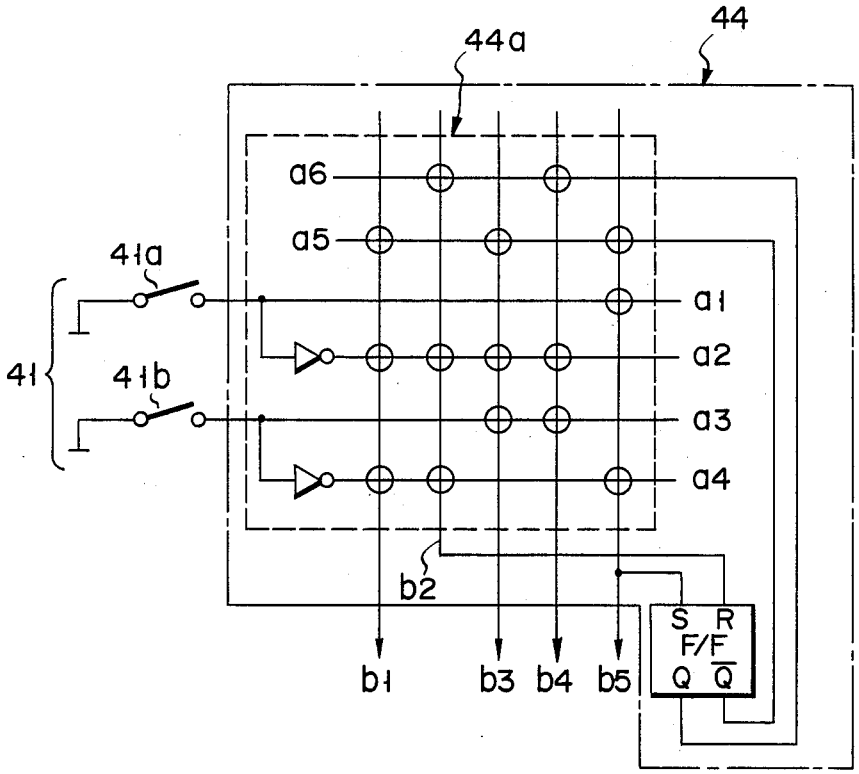
FIG. 9 shows a practical arrangement of a mode selection circuit shown in FIG. 8.

As shown in FIG. 9, mode selection circuit 44 for outputting the four types of mode selection signals has decoder 44*a* consisting of a plurality of gates and inverters, and flip-flop F. Mode selection circuit 44 outputs switch signals of the date/day mode, alarm mode, timer mode, and stopwatch mode in accordance with signals from elements 41*a* and 41*b* of mode selection switch 41. More particularly, input lines a1 to a4 of decoder 44 receive switch signals from elements 41*a* and 41*b* of mode selection switch 41 and inverted signals thereof. Input line a5 receives a $\overline{Q}$ signal from output terminal $\overline{Q}$ of flip-flop F, and input line a6 receives a Q output from output terminal Q thereof. In an initial state, input line a5 receives the $\overline{Q}$ signal from output terminal $\overline{Q}$ of flip-flop F. In this state, when elements 41*a* and 41*b* of mode selection switch 41 are both off, output line b1 outputs a selection signal for the dateday mode. When timepiece section 3 is pulled out by one step and elements 41*b* and 41*a* of mode selection switch 41 are turned on and off, respectively, output line b3 outputs a selection signal for the alarm mode. When timepiece section 3 is pulled out by two steps and elements 41*a* and 41*b* of mode selection switch 41 are turned on and off, respectively, output line b5 outputs a selection signal for the stopwatch mode and supplies a set signal to the set terminal of flip-flop F, thereby setting flip-flop F. Thus, the $\overline{Q}$ signal from output terminal $\overline{Q}$ of flip-flop F is disabled, and the $\overline{Q}$ signal is supplied from output terminal Q to input line a6. In this state, assume that timepiece section 3 pulled out by two steps is pushed in by one step to turn off and on elements 41*a* and 41*b*, respectively. Then, output line b4 outputs a selection signal for the timer mode. When timepiece section 3 is further pushed in to turn off both elements 41*a* and 41*b*, output line b2 outputs a reset signal to reset terminal R of flip-flop F in order to reset the same. Thus, the Q signal from terminal Q of flip-flop F is disabled, the $\overline{Q}$ signal is again supplied to input line a5 from terminal $\overline{Q}$, and the timepiece section 3 is returned to the initial state.

Counter circuit 27 supplies time data to switching circuit 28 and coincidence detection circuit 29 based on the 1-Hz signal from frequency dividing circuit 25. As shown in FIG. 6(A), day and date are displayed on display unit 15 in a state wherein timepiece section 3 is housed in housing 4*b*. More particularly, when timepiece section 3 is housed in housing 4*b*, elements 41*a*, and 41*b*, of mode selection switch 41 are turned off. These switching signals are supplied to mode selection circuit 44, a date/day mode signal is output from mode selection circuit 44 to display switching circuit 28, and day and date are displayed on display unit 15 among the time data supplied to display switching circuit 28.

Alarm time memory circuit 32 supplies stored alarm time data to detection and display switching circuits 29 and 28. When the alarm time data supplied to detection circuit 29 coincides with the time data supplied from counter circuit 27, a coincidence signal is output from detection circuit 29 to buzzer drive circuit 34, and an alarm sound is produced from speaker 35. In this case, when timepiece section 3 is pulled out by one step from housing 4*b*, as shown in FIG. 6(B), and display switching circuit 28 is switched to the alarm display mode by the mode selection signal from mode selection circuit 44, the alarm time data supplied to switching circuit 28 is displayed on display unit 15.

Stopwatch circuit 33 receives a 1/100-Hz signal from frequency dividing circuit 25 and supplies time count data of the stopwatch to switching circuit 28. Normally, the time count data is not displayed on display unit 15. When timepiece section 3 is pulled out from housing 4*b* by two steps and switching circuit 28 is switched to the stopwatch display mode by the mode selection signal from selection circuit 44, "00;00;00" is displayed on display unit 15.

Timer circuit 45 receives a 1-Hz signal from frequency dividing circuit 25 and supplies timer time count data to display switching circuit 28 in accordance therewith. The time count data is not usually displayed on display unit 15. When timepiece section 3 is pushed into digital housing 4*b* by one step from the two-step pulled-out state and display switching circuit 28 is switched to the timer mode by a mode selection signal from mode selection circuit 30, "00;00" is displayed on display unit 15. When select and set display switches 22*a* and 22*b* of key switch section 22 are operated, a digit select signal and a +1 set signal are output from input controller 31 to timer circuit 45, a timer time is set in accordance with these signals, and the set timer data is displayed on display unit 15 through switching circuit 28. At the same time, a 1-Hz signal is supplied from frequency dividing circuit 25 to timer circuit 45, and timer circuit 45 starts counting and supplies the count data to display unit 15 through switching circuit 28.

ADVANTAGES OF SECOND TIMEPIECE

In this manner, when a mode is switched in accordance with the shift of the slidable member which slides to project from and be retracted into the timepiece main body, and different mode selections are performed in accordance with the shift directions, selection can be performed among a plurality of modes with a small number of switches.

ARRANGEMENT OF THIRD TIMEPIECE

Figure 10:
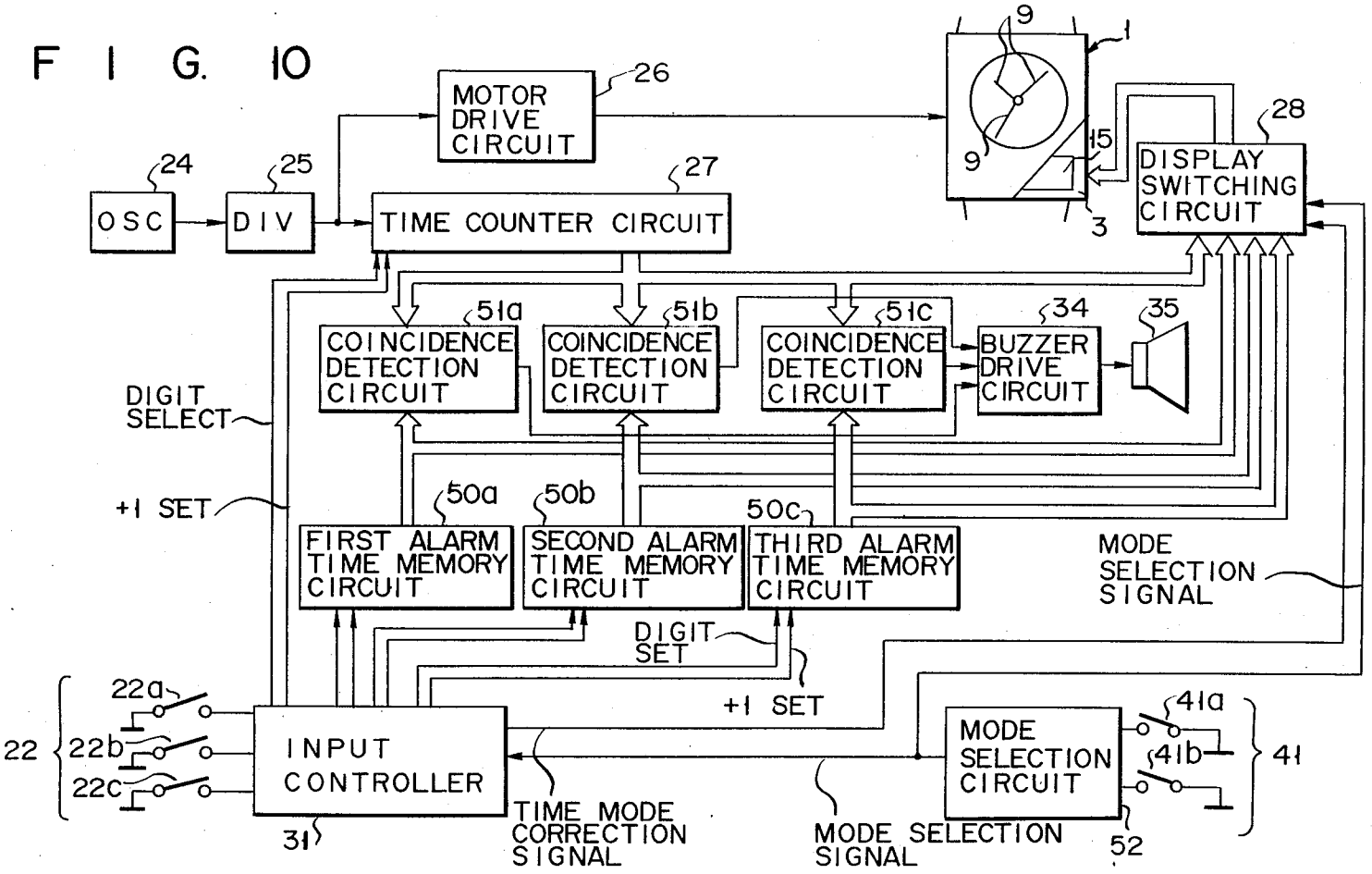
FIG. 10 is a circuit block diagram of an electronic timepiece according to a third embodiment of the present invention.
Figure 11:
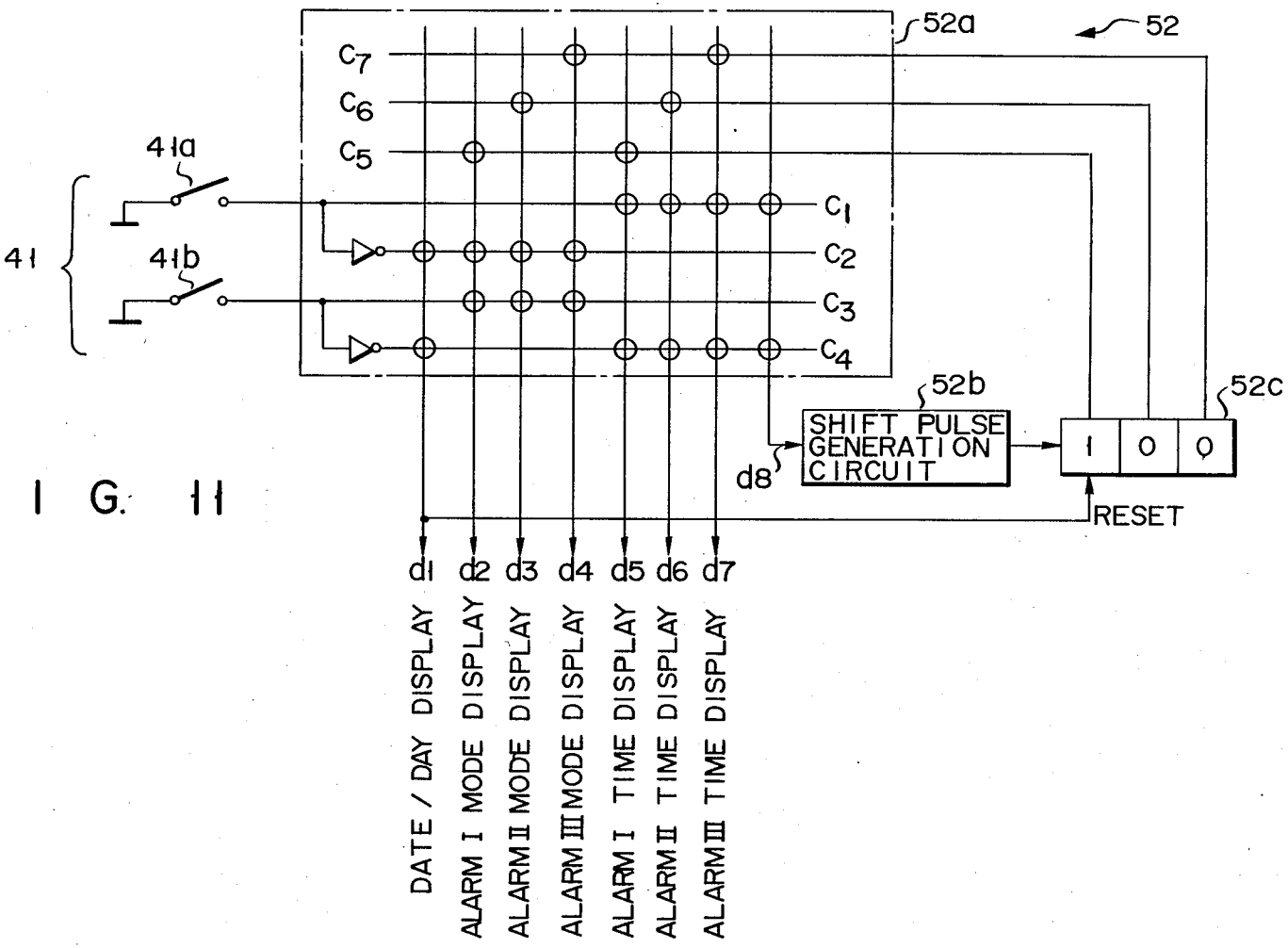
FIG. 11 shows a practical arrangement of a mode selection circuit shown in FIG. 10.
Figure 12:
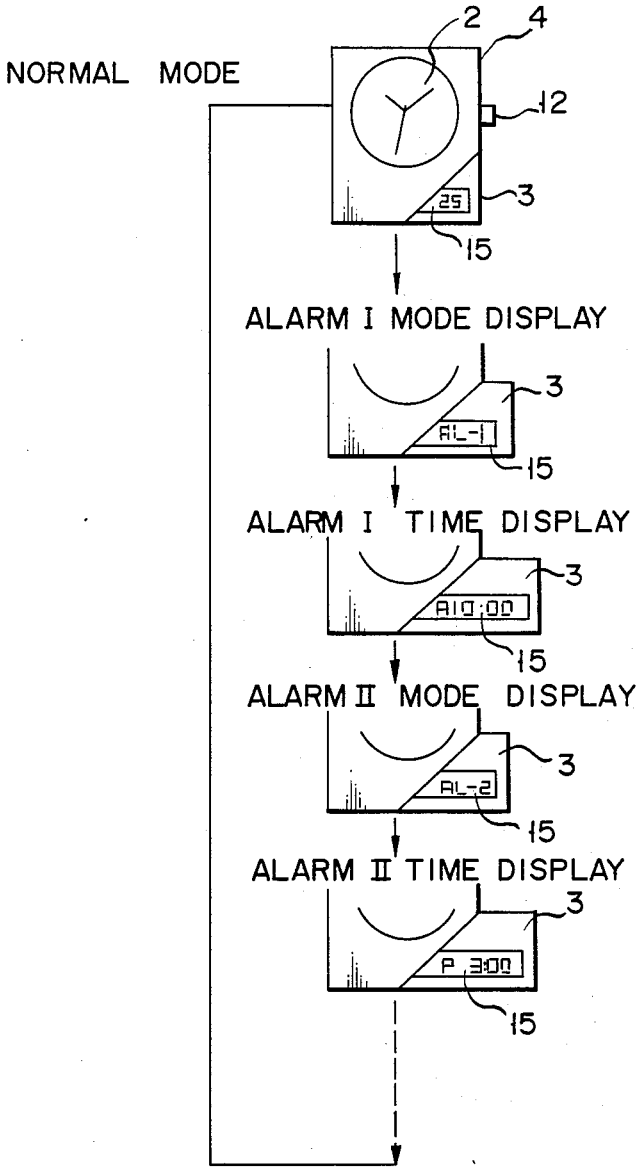
FIG. 12 shows operation specifications and display states of the third embodiment.

FIGS. 10 to 12 show a third embodiment of the present invention. In the third embodiment, a series of data are continuously switched by a continuous operation of pulling out and pushing in of digital timepiece section 3. More particularly, in the third embodiment, three alarm functions are provided. Date and day are usually displayed on display unit 15 of timepiece section 3. When timepiece section 3 is pulled out by one step, alarm I mode is displayed. When timepiece section 3 is then pulled out to a two-step pulled-out state, the alarm time of alarm I is displayed. When timepiece section 3 is then returned to a one-step pulled-out state, alarm II mode is displayed. When timepiece section 3 is pulled out to a two-step pulled-out state again, the alarm time of alarm II is displayed. When timepiece section 3 is then returned to a one-step pulled-out state, alarm III mode is displayed. When timepiece section 3 is pulled out to a two-step pulled-out state again, the alarm time of alarm III is displayed.

The circuit configuration of the third embodiment will now be described with reference to FIG. 10.

In this embodiment, first, second, and third alarm time memory sections 50*a*, 50*b*, and 50*c* for storing alarm times, and coincidence detection circuits 51*a*, 51*b*, and 51*c* for detecting coincidence between the respective alarm time data and the time data of counter circuit 27 are provided. When a coincidence is detected by detection circuit 51*a*, 51*b*, or 51*c*, a coincidence signal is output therefrom to buzzer drive circuit 34 to produce an alarm sound.

Mode selection switch 41 has an arrangement similar to that of the second embodiment. A switching signal from switch 41 is supplied to mode selection circuit 52.

Selection circuit 52 selects one of seven types of modes by a pulling operation of digital timepiece section 3 and supplies a mode selection signal to display switching circuit 28 and input controller 31. Selection circuit 52 has an arrangement as shown in FIG. 11. More particularly, selection circuit 52 has decoder 52*a* consisting of a plurality of gates and inverters, shift pulse generating circuit 52*b*, and shift register 52*c*. Selection circuit 52 outputs selection signals for date/day mode, alarm I, II, and III modes, and alarm times of alarms I, II, and III in accordance with signals from operation elements 41*a* and 41*b* of mode selection switch 41. In this case, input lines c1 to c4 of decoder 52*a* receive switching signals from elements 41*a* and 41*b* of mode selection switch 41 and inverted signals thereof, and input lines c5 to c7 thereof receive bit signals of shift register 52*c*. In the initial state, elements 41*a* and 41*b* of selection switch 41 are both turned off. Output line c1 outputs selection signals for the date/day mode to display switching circuit 28 and input controller 31, and a reset signal to register 52*c*. Register 52*c* is thus reset. Then, register 52*c* supplies a bit signal to input line c5. In this state, when digital timepiece section 3 is pulled out by one step and elements 41*a* and 41*b* of switch 41 are turned off and on, respectively, output line d2 outputs a selection signal for alarm mode I to display switching circuit 28. When timepiece section 3 is pulled out by two steps and elements 41*a* and 41*b* of mode selection switch 41 are turned on and off, respectively, output line d5 outputs a selection signal for displaying the alarm time data of alarm mode I to display switching circuit 28 and input controller 31, and output line d8 outputs an ON signal. In this state, assume that timepiece section 3 is pushed in by one step. Then, output line d8 outputs an OFF signal. Shift pulse generating circuit 52*b* detects a trailing edge of the OFF signal and supplies a shift pulse to register 52*c*, so that register 52*c* is shifted and outputs a bit signal to input line c6. Therefore, even when elements 41*a* and 41*b* are off and on, respectively, in a similar manner as in alarm mode I described above, alarm I mode is not displayed, but output line d3 outputs a selection signal for displaying alarm II mode to display switching circuit 28. When timepiece section 3 is again pulled out from this state, output line d6 supplies a selection signal for displaying the alarm time data of alarm mode II to display switching circuit 28 and input controller 31. When timepiece section 3 is pushed in by one step thereafter, register 52*c* is shifted in the same manner as described above and supplies a bit signal to input line c7. This time, output line d4 supplies a selection signal for displaying alarm III mode. In this manner, when pulling-in and pushing-out of timepiece section 3 are repeated, register 52*c* is returned to the initial state, and outputs a selection signal for displaying alarm I mode again through output line d2. Note that when timepiece section 3 is pushed in by two steps, it is returned to the initial date/day mode.

Input controller 31 receives a mode selection signal from mode selection circuit 52, and three types of switching signals from key switching section 22. In accordance with the switching signals, controller 31 outputs a digit select signal and a +1 set signal to time counter circuit 27, and alarm time memory circuits 32*a*, 32*b*, and 32*c*, respectively, in order to correct and set data displayed on display unit 15.

OPERATIONS OF THIRD TIMEPIECE

A description will now be made of the case wherein the electronic timepiece having the above configuration is used.

Normally, the present time is displayed by hands 9 on analog timepiece section 2, and data of a predetermined mode is displayed on display unit 15 of digital timepiece section 3. More particularly, when timepiece section 3 is pushed into digital housing 4*b* of timepiece case 4 and housed therein, operation elements 41*a* and 41*b* of mode selection switch 41 are turned off. The switching signals are supplied to mode selection circuit 52. Selection circuit 52 supplies a date/day signal to display switching circuit 28. Thus, timepiece section 3 is set in the date/day mode, and day and date are displayed on liquid crystal display unit 15 of timepiece section 3.

Subsequently, when digital timepiece section 3 is pulled out by one step, timepiece section 3 is set in the alarm I mode. More particularly, when timepiece section 3 is pulled out by one step, operation elements 41*a* and 41*b* of mode selection switch 41, are turned off and on, respectively. Thus, a selection signal for the alarm I mode is supplied from selection circuit 52 to switching circuit 28, so that AL-1 representing alarm I is displayed on display unit 15. When timepiece section 3 is pushed in by one step while AL-1 representing alarm I is displayed, it is switched to the date/day mode.

When timepiece section 3 is pulled out by two steps, it is set in a mode to display alarm time data of alarm I. More particularly, when timepiece section 3 is pulled out by two steps, elements 41*a* and 41*b* of mode selection switch 41, are turned on and off, respectively. Thus, a mode selection signal is supplied from mode selection circuit 52 to display switching circuit 28, and alarm time data of alarm I is displayed on display unit 15.

When timepiece section 3 is pushed in by one step from this state, it is then set in alarm II mode. More particularly, when timepiece section 3, pulled out by two steps, is pushed in by one step, shift register 52*c* of mode selection circuit 52 supplies a bit signal to input line c6. Thus, even when mode selection switch 41 is set in a similar manner to the alarm I mode described above, no mode selection signal is output from output line d2 but a selection signal for the alarm II mode is output from output line d3, and AL-2 is displayed in the alarm II mode.

When timepiece section 3 is pulled out by one step again from the above state, alarm time data of alarm II is displayed.

When timepiece section 3 is then pushed in by one step again, it is set in the alarm III mode. More particularly, when timepiece section 3 is pushed in by one step from the two-step pulled-out state, shift register 30*c* of mode selection circuit 52 supplies a bit signal to input line c7. Therefore, output line d3 outputs a selection signal for the alarm III mode, and alarm III mode is thus selected thereby. When timepiece section 3 is then pulled again from this state, alarm time data of alarm III is displayed.

When timepiece section 3 is shifted between the first and second steps in this manner, it is sequentially selected in the order of alarms I, II, and III, as described above, and is returned to alarm I again. Then, when timepiece section 3 is completely housed in digital housing 4*b* of timepiece case 4, it is returned to the initial date/day mode, and date and day are displayed on display unit 15.

MODIFIED OPERATIONS OF THIRD TIMEPIECE

Figure 13:
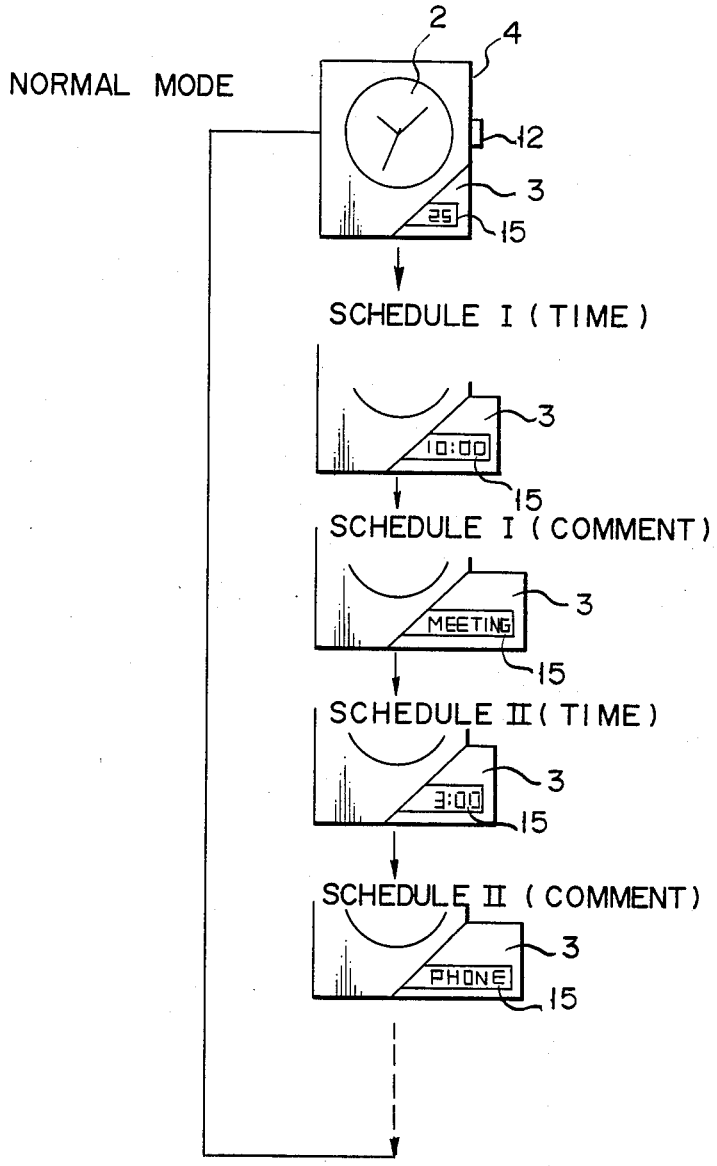
FIG. 13 shows operation specifications and display states of a modification of the third embodiment.

FIG. 13 shows a first modification of the third embodiment which is applied to a scheduler. More particularly, when digital timepiece section 3 is completely housed in digital housing 4*b* of timepiece case 4, it is set in a normal mode (the date day mode the same as in the third embodiment), and date and day are displayed on liquid crystal display unit 15 of timepiece section 3. When timepiece section 3 is pulled out by one step from this state, the time of schedule I is displayed. When timepiece section 3 is further pulled out by two steps, the content of the schedule (e.g., "MEETING") is displayed. When timepiece section 3 is then pushed in by one step, the time of schedule II is displayed. When timepiece section 3 is pulled again from this state, the content of the schedule (e.g., "PHONE") is displayed.

Figure 14:
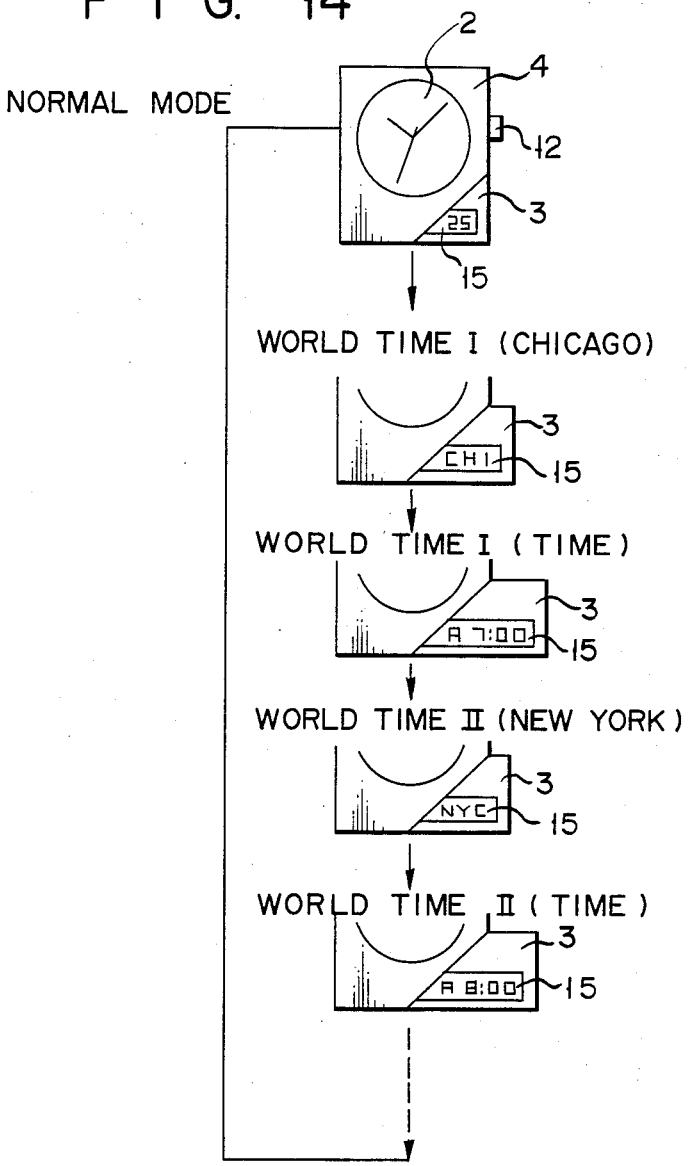
FIG. 14 shows operation specifications and display states of another modification of the third embodiment.

FIG. 14 shows a second modification of the third embodiment which is applied to a world time display timepiece. More particularly, as described above, when timepiece section 3 is completely housed in digital housing 4*b* of timepiece case 4, it is set in the normal mode (date day mode), and date and day are displayed on liquid crystal display unit 15 thereof. When timepiece section 3 is pulled out by one (first) step from this state, the name of a foreign country's city (e.g., Chicago) is displayed; when timepiece section 3 is pulled out by further one step (i.e., second step position), the time in the displayed city is displayed. Subsequently, when digital timepiece section 3 is pushed in by one step from the second step position, the name of another city (e.g., New York) is displayed. When it is again pulled out by one step (i.e., second step position), the time in the displayed city is displayed.

In this manner, according to the third embodiment, a multifunctional digital display unit is provided to the main body of the timepiece case to be capable of projecting and contracting for displaying a plurality of functions. Every time a series of operations of pulling out and pushing in the digital display unit are performed, functions of the digital display unit are switched. Therefore, the functions of the digital display unit can be switched easily and simply with a small number of switches with few erroneous operations.

ARRANGEMENT OF FOURTH TIMEPIECE

FIGS. 15 to 20 show a fourth embodiment of the present invention. The fourth embodiment is different from the third embodiment in the following points. Namely, in the fourth embodiment, a timer is started by the movement of a digital timepiece section, and crown 12 is used in place of key switch section 22 so that time correction and alarm and timer time setting are performed thereby.

More particularly, when crown 12 is pulled out by one step, correction switch 12*a* is turned on, and the mode displayed on a display unit can be corrected or set. When crown 12 is rotated counterclockwise, select switch 12*b* is turned on to output a digit select signal, and a digit to be corrected of data displayed on liquid crystal display unit 15 is selected and set thereby. When crown 12 is rotated clockwise, set switch 12*c* is turned on to output a "+1" set signal and a digit to be corrected is incremented by one and corrected. Note that when crown 12 is pulled out by two steps, the time displayed by analog timepiece section 2 can be corrected. Subsequently, when crown 12 is turned clockwise or counterclockwise in this state, hands 9 of timepiece section 2 are moved, thereby correcting the time.

CIRCUIT ARRANGEMENT OF THIRD TIMEPIECE

Figure 15:
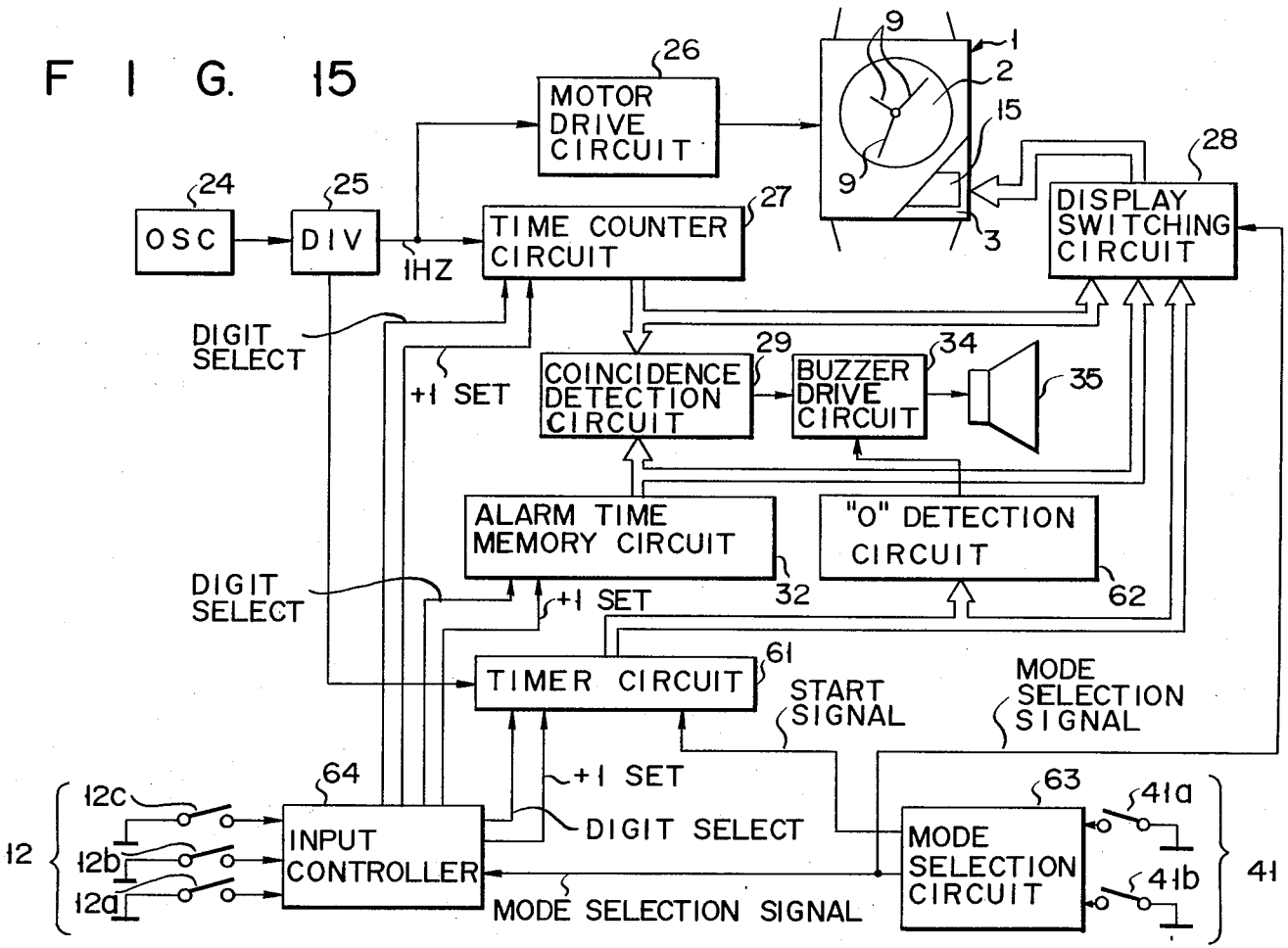
FIG. 15 is a circuit block diagram of an electronic timepiece according to a fourth embodiment of the present invention.

The circuit configuration of electronic timepiece 1 will now be described with reference to FIG. 15.

Timer circuit 61 receives a 100-Hz signal from frequency dividing circuit 25, and starts down-counting from a time preset by a start signal supplied from mode selection circuit 63 to be described later. The content of timer circuit 61 is supplied to "0" detection circuit 62. When "0" detection circuit 62 detects that the remaining time of timer circuit 61 becomes "0", it supplies a drive signal for buzzer drive circuit 34 to produce an alarm sound.

Figure 16:
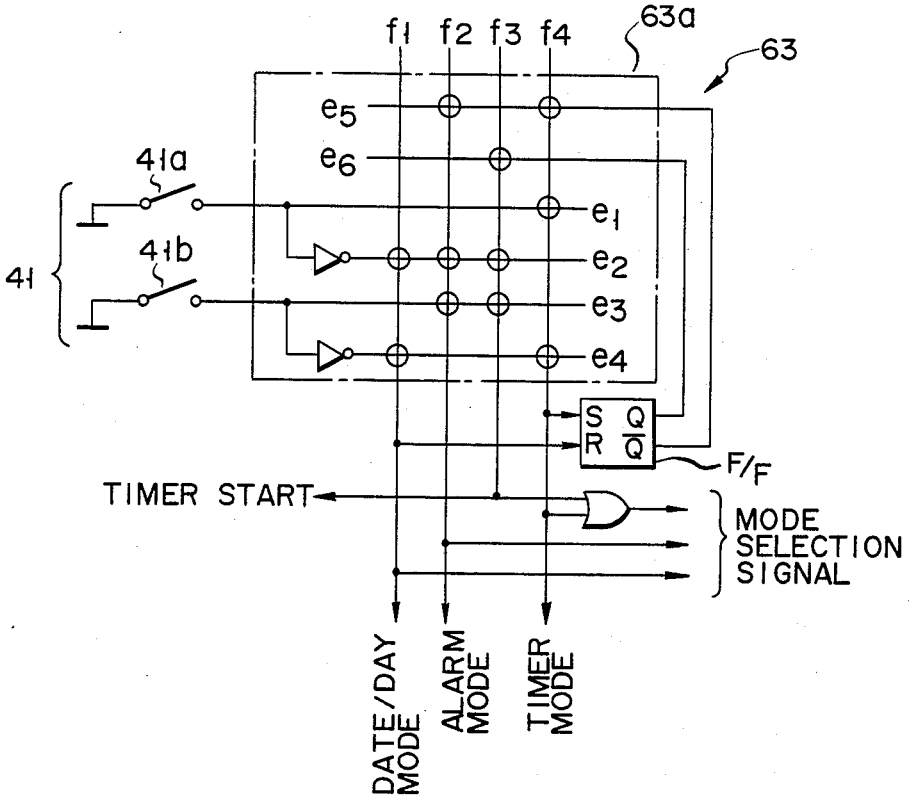
FIG. 16 shows a practical arrangement of a mode selection circuit shown in FIG. 15.
Figure 17:
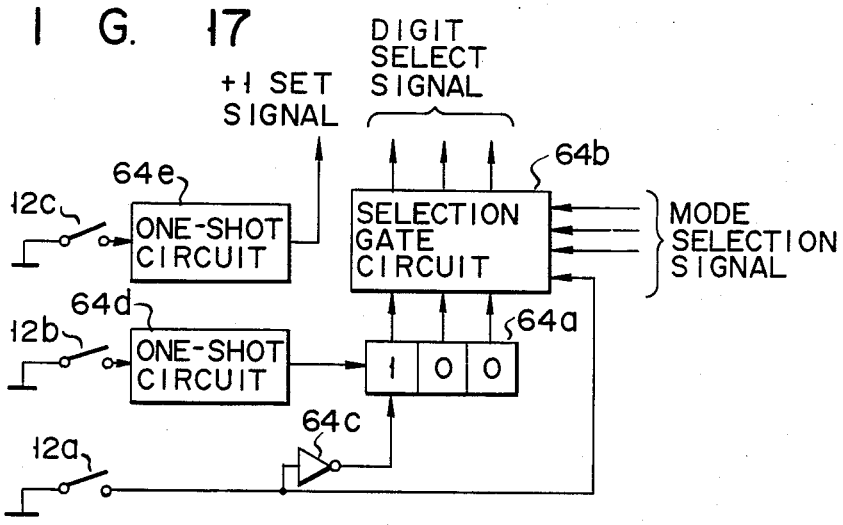
FIG. 17 shows a practical arrangement of an input controller shown in FIG. 15.

Selection circuit 63 selects one of three types of modes by a pulling operation of digital timepiece section 3, supplies mode selection signals to display switching circuit 28 and input controller 31, and outputs a start signal in the timer mode. Selection circuit 52 has an arrangement as shown in FIG. 16. More particularly, selection circuit 63 has decoder 63*a* consisting of a plurality of gates and inverters, and flipflop F, and outputs selection signals for date/day, alarm, and timer modes in accordance with signals from operation elements 41*a* and 41*b* of mode selection switch 41. In this case, input lines e1 to e4 of decoder 63*a* receive switching signals from elements 41*a* and 41*b* of mode selection switch 41 and inverted signals thereof, input line e5 thereof receives a $\overline{Q}$ signal from output terminal $\overline{Q}$ of flip-flop F, and input line e6 thereof receives a Q signal from output terminal Q of flip-flop F. In the initial state, elements 41*a* and 41*b* of selection switch 41 are both turned off. Output line f1 outputs a selection signal for the date/day mode, and a reset signal to reset terminal R of flip-flop F, so that output terminal $\overline{Q}$ of flip-flop F supplies a $\overline{Q}$ signal to input line e5. In this state, when digital timepiece section 3 is pulled out by one step and elements 41*a* and 41*b* of switch 41 are turned off and on, respectively, output line f2 outputs a selection signal for the alarm mode. When timepiece section 3 is further pulled out by one step and elements 41*a* and 41*b* of mode selection switch 41 are turned on and off, respectively, output line f4 outputs a selection signal for the timer mode, and supplies a set signal to set terminal S of flip-flop F. Then, a $\overline{Q}$ signal from output terminal $\overline{Q}$ of flip-flop F is disabled, and a Q signal of output terminal Q thereof is supplied to input line e6. In this state, when timepiece section 3, pulled out by two steps, is pushed in by one step to turn off and on elements 41*a* and 41*b*, respectively, output line f3 outputs a timer start signal and a mode selection signal. In this case, the timer start signal is supplied to timer circuit 61, and the mode selection signal is supplied to display switching circuit 28 to display a timer time on liquid crystal display 15. Subsequently, when timepiece section 3 is further pushed in to turn off both elements 41*a* and 41*b*, output line f1 outputs a selection signal for the date/day mode, and supplies a reset signal to reset terminal R of flip-flop F so as to reset flip-flop F. Thus, mode selection circuit 63 is returned to the initial state.

Figure 18:
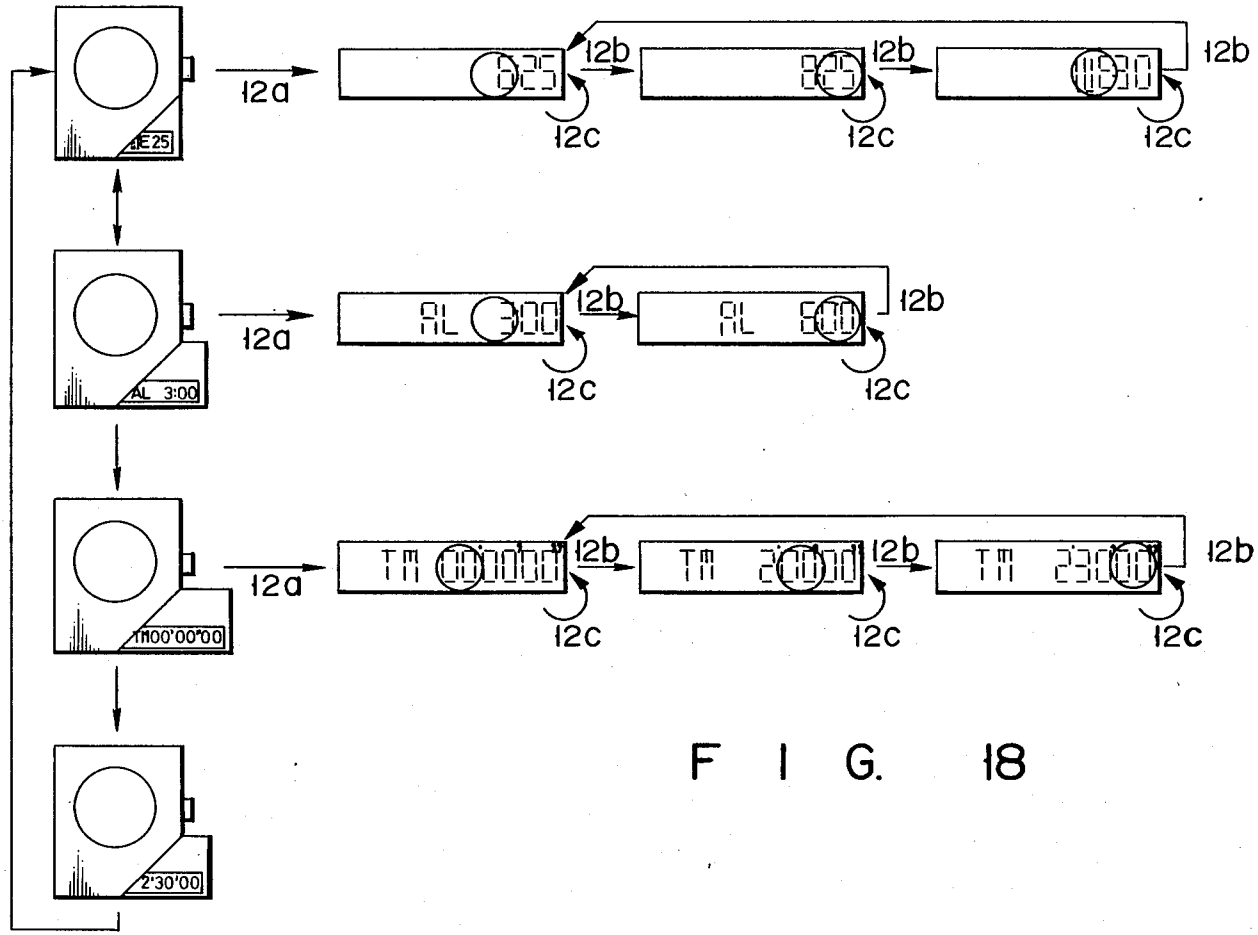
FIG. 18 shows operation specifications and display states of the fourth embodiment.

Input controller 64 receives a mode selection signal from mode selection circuit 63, and three types of switching signals from crown 12. In accordance with the switching signals, controller 64 outputs a digit select signal and a +1 set signal to time counter circuit 27, alarm time memory circuit 32, and timer circuit 61, respectively, in order to correct and set data displayed on crystal display unit 15. More specifically, input controller 64 consists of switches 12*a*, 12*b*, and 12*c* of crown 12, digit selection circuit 64*a*, selection gate circuit 64*b*, and so on. Correction switch 12*a* is turned on crown 12 is pulled out by one step, and supplies the ON signal to digit selection circuit 64*a* through inverter 64*c* and also to selection gate circuit 64*b*, thereby releasing reset of the digital selection circuit 64*a*. Select switch 12*b* is turned on when crown 12 is pulled out by one step and rotated counterclockwise, and supplies the ON signal to selection circuit 64*a* through one-shot circuit 64*d*. Resetting of selection circuit 64*a* is released when switch 12*a* is turned on. In this state, when selection circuit 64*a* receives a oneshot signal from select switch 12*b* through one-shot circuit 64*d*, it carries and selects digits to be corrected by sequentially shifting the digits in response to every one-shot signal, and supplies the selected signal to selection gate circuit 64*b*. Selection gate circuit 64*b* operates upon reception of the ON signal from correction switch 12*a*, and supplies the digit select signal to one of time counter circuit 27, alarm time memory circuit 32, and timer circuit 61 in accordance with the signal from digit selection circuit 64*a* and the mode signal selected by selection circuit 63, thereby performing digit selection. In this manner, the selected display data is corrected by set switch 12*c*. More specifically, switch 12*c* is turned on when crown 12 is pulled out by one step and rotated clockwise, and supplies the ON signal to one-shot circuit 64*e*. One-shot circuit 64*e* supplies a "+1" set signal to one of time counter circuit 27, alarm time memory circuit 32, and timer circuit 61 in order to correct the digit to be corrected. Therefore, in a state wherein crown 12 is pulled out by one step (correction state), even when digital timepiece section 3 projects or is contracted and input controller 64 is switched to another mode, the newly selected mode is the same as that obtained by shifting the prior corrected mode. For example, when the "month" digit is a correction state in the date/day mode, as shown in FIG. 18, if timepiece section 3 is pulled out by one step and is switched to the alarm mode, the "hour" digit of an alarm time can be corrected. When the "day" digit is continuously turned on and off and is thus in the correction state in the date/day mode, if timepiece section 3 is pulled out by one step and is switched to the alarm mode, the "minute" digit of the alarm time can be corrected. Similarly, one mode is shifted to the preceding mode even in a transition state between the alarm and timer modes.

OPERATIONS OF FOURTH TIMEPIECE

A case will be described wherein the electronic timepiece having the above arrangement is used.

Normally, the current time is displayed by hands 9 on analog timepiece section 2, and data of a predetermined mode is displayed on liquid crystal display unit 15 of digital timepiece section 3. More specifically, when timepiece section 3 is pushed and housed in digital housing 4*b* of timepiece case 4, operation elements 41*a* and 41*b* of mode selection switch 41 are both turned off. The switching signals are supplied to mode selection circuit 63. Mode selection circuit 63 supplies a dateday mode signal to switching circuit 28. Thus, digital timepiece section 3 is set in the date/day mode. Therefore, in the date/day mode, day and date are displayed on display unit 15 of digital timepiece section 3. In the date/day mode, when date or day is to be corrected, crown 12 may be pulled out by one step and rotated clockwise or counterclockwise by an appropriate amount. More particularly, when crown 12 is pulled out by one step, correction switch 12*a* is turned on. The ON signal is input to digit selection circuit 64*a* of input controller 64 through inverter 64*c* and cancels the reset state of digit selection circuit 64*a*. In this state, when crown 12 is rotated counterclockwise, select switch 12*b* is turned on, and a one-shot signal is supplied from one-shot circuit 64*d* to digit selection circuit 64*a*. Therefore, selection circuit 64*a* is shifted and a digit to be corrected is selected. A correction digit signal selected in this manner is supplied to selection gate circuit 64*b* and then to time counter circuit 27 as a digit select signal. In this state, when crown 12 is rotated clockwise, set switch 12*c* is turned on, a "+1" set signal is supplied from one-shot circuit 64*e* to time counter circuit 27, and the digits of display unit 15 to be corrected and continually turned on and off are sequentially incremented by one and are thus corrected. After the display data is corrected in this manner, crown 12 may be pushed in to the initial state.

When digital timepiece section 3 is pulled out by one step, it is set in the alarm mode. More specifically, when timepiece section 3 is pulled out by one step, operation elements 41*a* and 41*b* of mode selection switch 41, are turned off and on, respectively. Therefore, a selection signal for displaying the alarm time data is supplied from selection circuit 63 to display switching circuit 28, and the alarm time is thus displayed on display unit 15. In the alarm mode, when the alarm time data is to be corrected or set, it is corrected by pulling out crown 12 by one step in the manner as described in the case of the above date/day mode and rotating the same clockwise or counterclockwise by an appropriate amount, and the corrected alarm time data is displayed on display unit 15 through switching circuit 28. In this state, when timepiece section 3 is pushed in by one step, it is switched in the date/day mode, and the correction state described above continues and is switched to the correction state for the date/day mode.

When digital timepiece section 3 is pulled out by two steps, it is set in the timer mode. More specifically, when timepiece section 3 is pulled out by two steps, elements 41*a* and 41*b* of mode selection switch 41 are turned on and off, respectively. Therefore, a selection signal of a timer mode is supplied from selection circuit 63 to switching circuit 28, and timepiece section 3 is thus set in the timer mode. In the timer mode, when timer time data is to be corrected or set, it can be set by pulling out crown 12 by one step in the same manner as in the case of the date/day mode described above and rotating the same clockwise or counterclockwise. The timer time data is displayed on display unit 15 through switching circuit 28. The timer mode is started by pushing two-step pulled-out timepiece section 3 by one step. More specifically, when timepiece section 3 is pushed in by one step, output line f3 of mode selection circuit 63 outputs a mode selection signal and a timer start signal. The mode selection signal is supplied to switching circuit 28 to display the timer data on display unit 15. The timer start signal is supplied to timer circuit 61, as shown in FIG. 15. As a result, a frequency dividing circuit incorporated in timer circuit 61 starts counting the 100-Hz signal supplied from frequency dividing circuit 25, and changing data (remaining time) is displayed on display unit 15 through switching circuit 28. When the remaining time becomes "0", a detection signal is supplied from "0" detection signal from buzzer drive circuit 34, and an alarm sound is produced from speaker 35.

ADVANTAGES OF FOURTH TIMEPIECE

As described above, switching among time measurement functions, such as timer and stopwatch modes, can be performed by pulling out a digital display unit provided on the electronic timepiece main body to be capable of projecting and being contracted. Also, measurement can be started by pushing in the digital display unit. Therefore, switching start, and stop of functions of a digital display unit can be performed easily, simply, and with a small number of switches with few erroneous operations.

OTHER MODIFICATIONS

Figure 19:
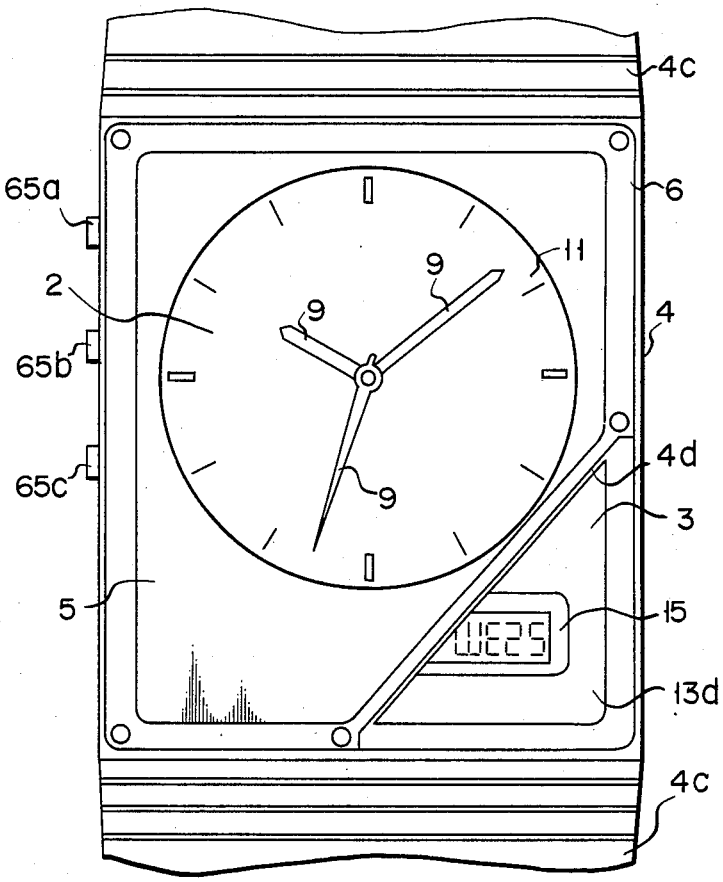
FIG. 19 shows an outer appearance of a modification of the electronic timepiece of the fourth embodiment.
Figure 20:
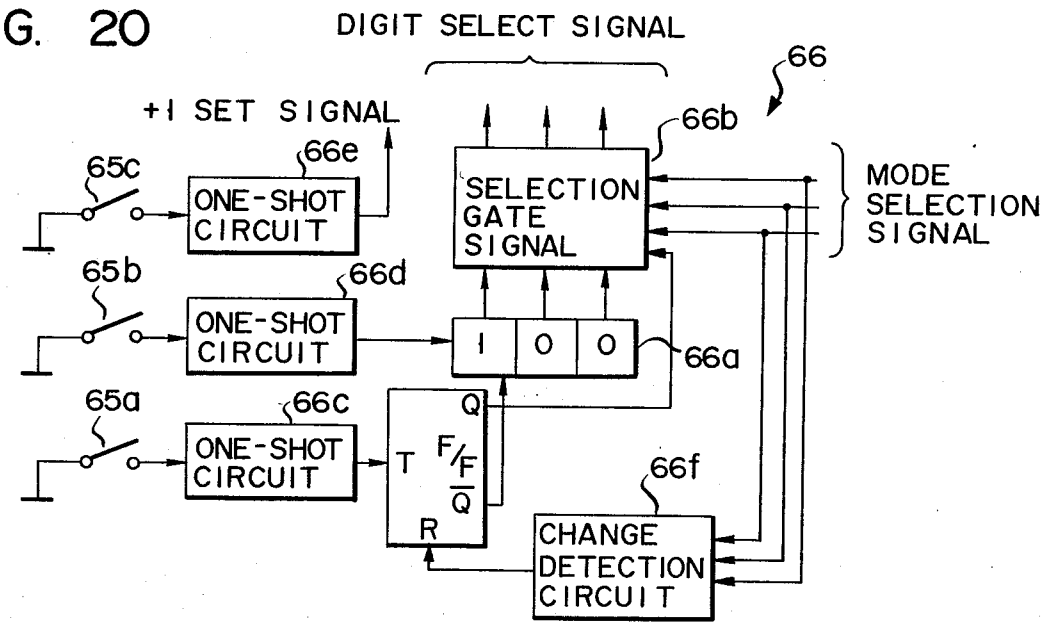
FIG. 20 shows an input controller of the same.

FIGS. 19 and 20 show a modification of the input controller. According to this modification, as shown in FIG. 19, three buttons 65*a*, 65*b*, and 65*c* are provided on the wall of timepiece case 4 to correct and set data in place of crown 12 which corrects and sets data displayed on liquid crystal display unit 15. In this case, input controller 66 has a configuration shown in FIG. 20. More specifically, three buttons 65*a*, 65*b*, and 65*c* serve as correction, select, and set switches 12*a*, 12*b*, and 12*c* of the embodiments described above, respectively. Switches or buttons other than switch 65*a* described above have the same configuration as the above embodiments. The ON signal of switch 65*a* is supplied to trigger terminal T of flip-flop F through oneshot circuit 66c. When flip-flop F generates an output at its output terminal $\overline{Q}$, it supplies a reset signal to digit selection circuit 66a to reset the same. When correction switch 65a is turned on to supply a signal to trigger terminal T, the output terminals of flip-flop F are switched and a Q signal is output from output terminal Q of flip-flop F to cancel the reset state of digit selection circuit 66a. At the same time, selection gate circuit 66b is enabled, thus enabling correction and setting of data. Note that reset terminal R of flip-flop F receives a detection signal from change detection circuit 66f which detects a mode switching. Upon reception of the detection signal, flip-flop F is reset. In input controller 66 having the above arrangement, even if it is set in a correction state for the selected mode, erroneous correction can be prevented because the correction state can be cancelled by moving digital timepiece section 3 and hence changing the mode.

ARRANGEMENT OF FIFTH TIMEPIECE

Figure 21A:
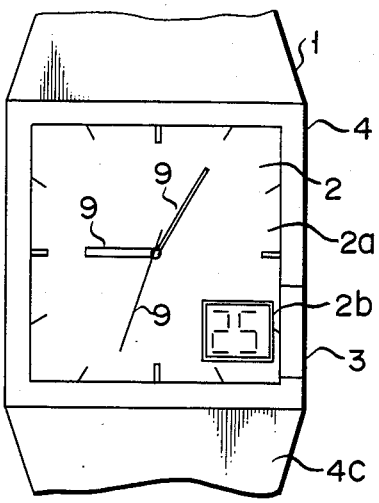
FIG. 21(A) shows an outer appearance in a state wherein a digital timepiece section is housed.
Figure 21B:
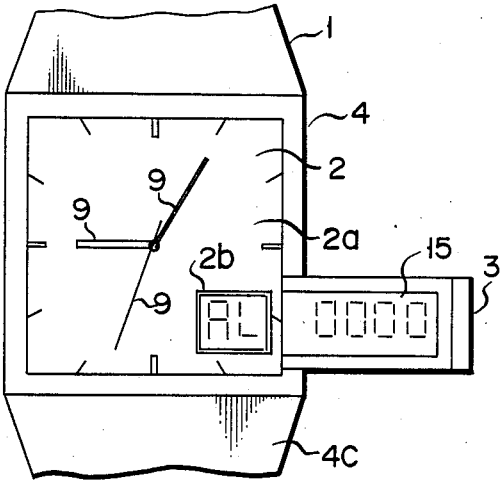
FIG. 21(B) shows an outer appearance in a state wherein the digital timepiece section is pulled out in one step.
Figure 21C:
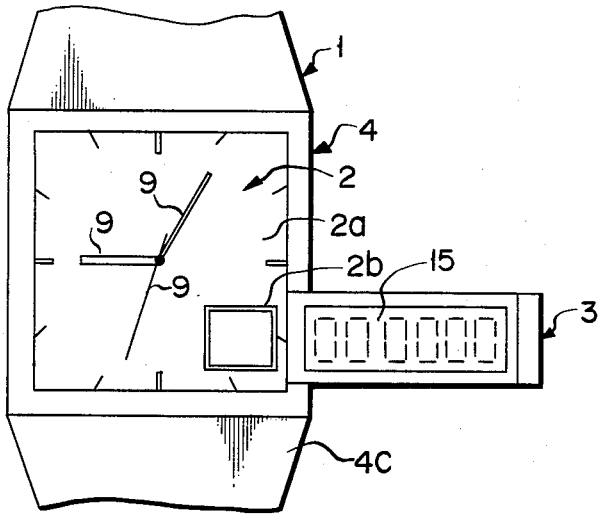
FIG. 21(C) shows an outer appearance in a state wherein the digital timepiece section is pulled out in two steps.

FIGS. 21(A), 21(B), and 21(C) show a fifth embodiment of the present invention. In this embodiment, window 2b is formed in part of dial 2a. Data displayed on display unit 15 of digital timepiece section 3 can be seen through window 2b. When timepiece section 3 is housed inside the case, the date is displayed by the two right digits of display unit 15, as shown in FIG. 21(A), and the data can be seen through window 2b. When timepiece section 3 is pulled out by one step, an alarm time is displayed by the four right digits of display unit 15, as shown in FIG. 21(B). "AL" indicating that timepiece section 3 is in the alarm time mode is displayed by the two left digits of display unit 15 and is seen through window 2b. When timepiece section 3 is pulled out by two steps, it is set in the stopwatch mode, as shown in FIG. 21(C).

What is claimed is:

1. An electronic timepiece comprising:

a timepiece case;

an electronic circuit, provided inside said timepiece case, for outputting a plurality of data items containing time data;

a slidable member arranged inside said timepiece case, including an optical display unit, and slidable to at least first and second stop positions, said optical display unit being exposed to the outside of said timepiece case with having a larger display region when said slidable member has been slid to the second stop position rather than to the first stop position;

detecting means for detecting that said slidable member has been slid to the first and second stop positions, respectively;

first data supply means for supplying one data item of said plurality of data items output from said electronic circuit to said exposed optical display unit when said detecting means detects that said slidable member has been slid to the first stop position; and second data supply means for supplying another data item of said plurality of data items output from said electronic circuit to said exposed optical display unit when said detecting means detects that said slidable member has been slid to the first stop position.

2. A timepiece as claimed in claim 1, wherein said electronic circuit comprises a date counter circuit for obtaining date data, and said first data supply means supplies said date data to said optical display unit when said detecting means detects that said slidable member has been slid to the first stop position.

3. A timepiece as claimed in claim 1, wherein said electronic circuit comprises a date counter circuit and a day counter circuit for obtaining date data and day data, respectively, and said first data supply means supplies said day and date data to said optical display unit when said detecting means detects that said slidable member has been slid to the first stop position.

4. A timepiece as claimed in claim 1, wherein said electronic circuit comprises an alarm circuit for producing alarm time data and an alarm sound at a preset alarm time, and said second data supply means supplies said alarm time data to said optical display unit when said detecting means detects that said slidable member has been slid to the second stop position.

5. A timepiece as claimed in claim 1, wherein said electronic circuit comprises a stopwatch circuit for producing measurement data, and said second data supply means supplies said measurement data of said stopwatch circuit when said detecting means detects that said slidable member has been slid to the second stop position.

6. A timepiece as claimed in claim 5, wherein said electronic circuit further comprises start control means for starting said stopwatch circuit when said detecting means detects that said slidable means has been slid.

7. A timepiece as claimed in claim 1, wherein said electronic circuit further comprises a timer circuit for producing time data, and said second data supply means supplies said time data of said timer circuit when said detecting means detects that said slidable member has been slid to the second stop position.

8. A timepiece as claimed in claim 7, wherein said electronic circuit further comprises a start circuit for starting said timer circuit when said detecting means detects that said slidable member has been slid.

9. A timepiece as claimed in claim 1, wherein said slidable member is orovided with a switch for controlling the data displayed on said optical display unit, and said switch is not exposed to the outside of said timepiece case when said slidable member is at the first position.

10. A timepiece as claimed in claim 1, wherein said timepiece case is a watch case.

11. A timepiece as claimed in claim 1, wherein an analog time display section is provided on a front face of said timepiece case, said analog time display section serving to display a time by hands based on a signal from said electronic circuit.

12. A timepiece as claimed in claim 11, wherein said analog time display section comprises hour, minute, and second hands, and a crown.

13. An electronic timepiece comprising:

a timepiece case:

an electronic circuit, provided inside said timepiece case, for outputting a plurality of data items containing time data;

a slidable member arranged within said timepiece case, including an optical display unit, and slidable to at least first, second, and third stop positions, the first position being the position at which said slidable member is housed in said timepiece case, and said optical display unit being exposed to the outside of said timepiece case with having a larger display region when said slidable member has been slid to the third stop position rather than to the second stop position;

detecting means for detecting that said slidable member has been slid to the first, second, and third stop positions, respectively;

first data supply means for supplying one data item of said plurality of data items output from said electronic circuit to said exposed optical display unit when said detecting means detects that said slidable member has been slid to the second stop position; and second data supply means for supplying another data item of said plurality of data items output from said electronic circuit to said exposed optical display unit when said detecting means detects that said slidable member has been slid to the third stop position.

14. A timepiece as claimed in claim 13, wherein said detecting means comprises shift direction detecting means for detecting that said slidable member has been slid from the first to second stop positions and from the third to second stop positions to produce a shift direction output; and said first data supply means supplies different data items from said electronic circuit to said optical display unit when said slidable member has been slid to the second stop position in response to said shift direction output.

15. A timepiece as claimed in claim 13, wherein said slidable member is provided with a plurality of switches, and the numbers of exposed switches are different from each other when said slidable member has been slid to the second and third stop positions.

16. A timepiece as claimed in claim 13, wherein said slidable member is provided with a switch, and said electronic circuit comprises means for changing the functions of said switch when said detecting means detects that said slidable means has been slid to the second and third stop positions.

17. A timepiece as claimed in claim 13, wherein said slidable member is provided such that said optical display unit is exposed when said slidable member has been slid to the first stop position, and that said exposed region of the optical display unit is smaller when said slidable member has been slid to the first position rather than to the second position.

18. A timepiece as claimed in claim 17, further comprising date data supply means for supplying date data to said optical display unit when said detecting means detects that said slidable means is at the first stop position.

19. A timepiece as claimed in claim 13, wherein an analog time display section is provided on a front face of said timepiece so as to display a time with hands in accordance with the output supplied from said electronic circuit.

20. An electronic timepiece comprising:

a timepiece case having an analog time display section for displaying a time with hands;

an electronic circuit, provided inside said timepiece case, for outputting a plurality of data items containing date data;

a slidable member provided within said timepiece case, including an optical display unit, and slidable to at least first and second stop positions, said optical display unit being exposed to the outside of said timepiece case with a larger display region when said slidable member has been slid to the second stop position rather than to the first stop position;

first data supply means for supplying said date data to said exposed optical display unit when said slidable member is at the first stop position; and second data supply means for supplying to said exposed optical display unit another data item of the plurality of data items obtained by said electronic circuit when said slidable member is at the second stop position.

21. A timepiece as claimed in claim 20, wherein said slidable member is movably provided in said timepiece case such that said slidable member is housed in said timepiece case when it is at the first stop position and that it projects from said timepiece case when it is at the second stop position.

22. A timepiece as claimed in claim 20, wherein said optical display means is a liquid crystal display unit.

23. A timepiece as claimed in claim 20, wherein:

said slidable member is further slidable to a third stop position, and said optical display unit is exposed to the outside of said timepiece case with having a larger display region when said slidable means has been slid to said third stop position rather than to the second stop position, said timepiece further comprising:

third data supply means for supplying another data item to said optical display means when said slidable member is at the third stop position.

24. A timepiece as claimed in claim 20, wherein said analog time display section is provided with a dial, and said display region of said exposed optical display unit does not overlap on said face when said slidable member is at the first stop position.

25. A timepiece as claimed in claim 20, wherein said analog time display section is provided with a dial having a hole, and said display region of said optical display unit is exposed from the hole when said slidable member is at the first stop position.

* * * * *